US011087969B2

(12) United States Patent
Peterson et al.

(10) Patent No.: US 11,087,969 B2
(45) Date of Patent: Aug. 10, 2021

(54) CHARGE DETECTION FOR ION CURRENT CONTROL

(71) Applicant: Thermo Fisher Scientific (Bremen) GmbH, Bremen (DE)

(72) Inventors: Amelia Corinne Peterson, Bremen (DE); Jan-Peter Hauschild, Weyhe (DE); Alexander Kholomeev, Bremen (DE); Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/864,895

(22) Filed: May 1, 2020

(65) Prior Publication Data

US 2020/0357627 A1 Nov. 12, 2020

(30) Foreign Application Priority Data

May 9, 2019 (GB) ..... 1906546

(51) Int. Cl.
*H01J 49/42* (2006.01)

(52) U.S. Cl.
CPC ..... *H01J 49/4265* (2013.01); *H01J 49/4225* (2013.01)

(58) Field of Classification Search
CPC .... H01J 49/4265; H01J 49/4225; H01J 49/42; H01J 49/426; H01J 49/427
(Continued)

(56) References Cited

U.S. PATENT DOCUMENTS 5,107,109 A 4/1992 Stafford, Jr. et al.
5,559,325 A 9/1996 Franzen
(Continued)

FOREIGN PATENT DOCUMENTS

WO WO-03019614 A2 3/2003
WO WO-2004068523 A2 8/2004
(Continued)

OTHER PUBLICATIONS

Bazhenov et al., "Gas-Dynamic Fluctuations and Noises in the Interface of an Atmospheric Pressure Ionization Ion Source," Journal of Analytical Chemistry, 2011, vol. 66, No. 14, pp. 1392-1397.
(Continued)

*Primary Examiner* — Nicole M Ippolito

(57) ABSTRACT

A method for controlling the filling of an ion trap with a predetermined quantity of ions. The method comprises generating an ion current by transmitting ions along an ion path to an ion trap, such that ions are accumulated in the ion trap over a transmission time period, wherein the magnitude of the ion current varies in time. The method further comprises detecting at an ion detector at least some ions from the source of ions during a plurality of distinct sampling time intervals interspersed within the transmission time period, and setting the duration of the transmission time period based on the detection of ions at the ion detector. The time difference between the start of a sampling time interval and the start of an immediately subsequent sampling time interval is less than a timescale for variation of the magnitude of the ion current. A controller for controlling the filling of an ion trap with a predetermined quantity of ions and a mass spectrometer comprising the controller is also described.

34 Claims, 11 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 5,572,022 | A | 11/1996 | Schwartz et al. | |
| 5,739,530 | A | 4/1998 | Franzen et al. | |
| 6,294,780 | B1 * | 9/2001 | Wells | H01J 49/147 250/288 |
| 6,555,814 | B1 | 4/2003 | Baykut et al. | |
| 6,600,154 | B1 | 7/2003 | Franzen et al. | |
| 2013/0214054 | A1 * | 8/2013 | Faulkner | B05B 5/03 239/3 |
| 2016/0217985 | A1 | 7/2016 | Makarov | |
| 2019/0027348 | A1 * | 1/2019 | Pandurangan | H01J 49/0036 |

FOREIGN PATENT DOCUMENTS

| | | | |
|---|---|---|---|
| WO | WO-2005093782 | A2 | 10/2005 |
| WO | WO-2007122383 | A2 | 11/2007 |
| WO | WO-2012160001 | A1 | 11/2012 |

OTHER PUBLICATIONS

Combined Search and Examination Report dated Oct. 17, 2019, for GB Patent Application No. 1906546.5.

Page et al., "Automatic Gain Control in Mass Spectrometry Using a Jet Disrupter Electrode in an Electrodynamic Ion Funnel", Journal of the American Society for Mass Spectrometry, 2005, vol. 16, pp. 244-253.

Combined Search and Examination Report dated Oct. 14, 2020, to GB Patent Application No. 2006783.1.

* cited by examiner

CHARGE DETECTION FOR ION CURRENT CONTROL

PRIORITY

This application claims priority to UK Patent Application 1906546.5, filed on May 9, 2019, and titled "Charge Detection for Ion Current Control," by Peterson et al., which is hereby incorporated herein by reference in its entirety.

FIELD OF THE INVENTION

The invention relates to a method and to a controller for controlling the filling of an ion trap with a predetermined quantity of ions. The invention may be used within mass spectrometry, in particular where an ion trap is employed.

BACKGROUND TO THE INVENTION

Many methods of mass spectrometry require the generation of ions which are subsequently passed, via ion optical means, to a storage or trapping cell ('ion trap') of a mass analyser for analysis. The quality of the resulting mass spectra has been found to be highly sensitive to the total number of ions introduced and trapped within the ion trap. On the one hand, the statistics of the collected mass spectra are improved by accumulation of as many ions as possible within the volume of the ion trap for subsequent analysis. However, this must be balanced with a conflicting requirement to reduce detrimental space charge effects. Space-charge effects occur when higher ion concentrations are present in the ion trap (when the ion concentration is above a space-charge limit), and result from a perturbation in an electrostatic field due to the presence of ions. As a consequence of space-charge effects, mass resolution of spectra is limited and shifts in the mass-to-frequency relationship of spectra can occur. Thus, it is an objective to optimise the total number of ions trapped within an ion trap to be below, but as close as possible to, the space-charge limit.

A process of Automatic Gain Control (AGC), by which the total abundance of ions accumulated in an ion trap can be controlled, is known in the art. This process requires the accumulation of ions in an ion trap over a known time period, after which a rapid total ion abundance measurement is performed by the mass analyser. The rate of filling of the ion trap can then be determined, in order to allow selection of an appropriate filing time for subsequent measurements to provide an optimum ion abundance in the trap. This process for AGC is described in U.S. Pat. No. 5,107,109 and WO 2005/093782, for instance.

Other methods for controlling filling of an ion trap have been proposed. For example, for RF ion traps as described in U.S. Pat. Nos. 5,572,022 and 6,600,154 it has been proposed to include a pre-scan just before the analytical scan. This pre-scan provides a feedback for automatically controlling the gating or fill time when introducing ions into the trap for the analytical scan. In particular, the pre-scan requires ions accumulated in a predetermined period of time to be passed to a detector, in order to determine an ion accumulation rate. U.S. Pat. No. 5,559,325 proposed extrapolating a multitude of pre-scans to determine an accumulation rate and associated fill time. In another method, disclosed in International Patent Publication No. WO 03/019614, an electrometer type detector of a triple quadrupole arrangement is used to measure the ion flux in a 'transmission mode' and over a pre-set time period. Consequently, a measurement period for subsequent analytical scans whilst the triple quadrupole arrangement is configured in a 'trapping mode' is determined.

Although calibration as described above is suitable in the majority of practical cases, it has been discovered that there are some circumstances in which such a pre-scan can give false or misleading estimates for the fill time. For example, the pre-scan is not capable of accurate prediction of ion filling rate if an ion current is rapidly decaying or exhibiting beat structure (e.g. for heavy proteins) or if an extremely complicated matrix is present with only a few intense peaks (such as in proteomics). To look to address this problem, International Patent Publication No. WO2012/160001 proposed use of an additional charge detector to correct a pre-scan reading from image current detection, in order to determine a target injection time for a subsequent analytical scan. To address a similar concern in FT-ICR, a method was proposed in U.S. Pat. No. 6,555,814 which includes trapping of ions in an external accumulation device, with subsequent release of just a subset of trapped ions and their detection, preferably with a dedicated detector. The measurement of the subset of trapped ions can be used to determine the number of ions stored in the accumulation device, and so whether further filling is required. However, in use the extraction of a portion of trapped ions can result in mass- and ion density-dependent effects.

U.S. Pat. No. 5,739,530 describes an apparatus including an RF ion guide prior to analysis in a quadrupole ion trap. A switchable ions lens is arranged between the RF ion guide and the quadrupole ion trap, in order to control filling of the ion trap. The ion lens can be briefly switched to allow entry of ions into the ion trap during a filling interval, wherein the filling time for the ion trap can be extrapolated from the degree of filing detected at the quadrupole ion trap during the filling interval. International Patent Publication No. WO 2004/068523 considers AGC in a more advanced scheme of a hybrid mass spectrometer, in which an ion trap is also used for accumulating ions prior to sending them to a mass analyser (typically a Fourier transform or one of either ICR or orbital trapping type). Here, an additional detector, which could be located near or prior to the ion trap, is used to measure the accumulation rate of ions and determine the injection time interval for an analytical scan. The additional detector may detect ions during a small number of intervals over the period of accumulation of the ions. However, the ion current is assumed to be approximately constant.

However, all the above-described methods of AGC exhibit difficulties when applied with rapidly varying or unstable ion sources or currents. It has been demonstrated that even classically 'continuous' ion sources such as electrospray suffer from beam instability at frequencies up to many kilohertz (Bazhenov et al., *Journal of Analytical Chemistry* (2011), vol. 66, No. 14, p 1392-1397). Pulsed ion sources, such as laser or MALDI sources, exhibit much stronger variations.

Thus, it is an objective of the present invention to provide a method for controlling the filling of an ion trap with a predetermined quantity of ions whilst avoiding overfilling the ion trap, even where the ion current supplied by the source of ions is inherently transient or unstable.

SUMMARY OF THE INVENTION

There is presently described a method for controlling the filling of an ion trap with a predetermined quantity of ions which looks to overcome the problems outlined above. A controller and mass spectrometer for implementing the same is also described.

The method requires intermittent detection of ions at an ion detector, the ions otherwise used to fill an ion trap. The ions are detected at the detector concurrently with the ion trap being filled. In this way, the ion current is 'sampled' during a number of sampling intervals spaced over the period of filling of the ion trap. Using a measurement of the sampled ion current, the quantity of ions detected at the ion detector during the total of the sampling intervals can be determined, and this can be extrapolated to estimate the quantity of ions received by the ion trap. Although the ion current varies with time, the inventors have recognised that by appropriate selection of the period of sampling of the ion current, variation in the ion current can be accurately monitored and so taken into account for determination of the filling time at the ion trap. Specifically, the sampling time intervals are substantially shorter than a characteristic time of variation in ion current. This allows a more precise estimate for the filling time of the ion trap, so as to avoid over- or under-filling the trap.

In a first aspect, there is described a method for controlling the filling of an ion trap with a predetermined quantity of ions, the method comprising:

generating a ion current by transmitting ions along an ion path, the ion path extending from a source of ions to an ion trap such that ions are accumulated in the ion trap over a transmission time period, wherein the magnitude of the ion current varies in time;

detecting at an ion detector at least some ions from the source of ions during a plurality of distinct sampling time intervals interspersed within the transmission time period;

setting the duration of the transmission time period based on the detection of ions at the ion detector; and wherein the time difference between the start of a sampling time interval and the start of an immediately subsequent sampling time interval is less than the timescale for variation of the magnitude of the ion current.

The method is intended to control the filling of an ion trap, and more specifically the number of ions accumulated at the ion trap. As a consequence of the method, the number of ions in the ion trap can be more precisely controlled in order to maximise the number of ions available for analysis whilst also reducing space-charge effects. The method achieves this by sampling the ion current, concurrently with filling of the ion trap, at a frequency that is faster than any changes or variation in the ion current, thereby providing an accurate and responsive indication of the rate of filling at the ion trap. By applying the described method, changes in the ion current that occur during the transmission time period (for example, due to an inherently unstable ion source, or due to use of a pulsed ion source) can be monitored and taken into account in determination of the transmission time.

It will be understood that the transmission time period is the time period for filling of the ion trap with a predefined quantity of ions. In other words, it is the time during which ions are supplied by the source of ions and are received by the ion trap after traversing the ion path. The ions are accumulated together in the ion trap, i.e. during one filling of the trap, so that under typical operation the trap is not emptied of ions during the transmission time period. The transmission time period is inclusive of the sampling time intervals and any time between the sampling time intervals. It also includes any period of time prior to the first sampling time interval and after the final sampling time interval when ions are received at the ion trap.

During the sampling time intervals (which are interspersed within the transmission time period) the ions are detected by the detector, either by receipt and collection at the ion detector, or by use of non-destructive charge techniques such as image charge detection. Thus, each sampling time interval is a time period during which the ions are detected at the detector. In some cases, only a portion of the ions from the ion source are received at the ion detector during the sampling time intervals, with any remaining ions continuing along the ion path to the ion trap. Nevertheless, ions are detected prior to reaching the ion trap. In some cases, ions may be collected at the detector during each sampling time interval, with detection of the ions at the end of each sampling time interval.

Setting the transmission time period may be considered an iterative process, and is based on the ions detected at the ion detector during any preceding sampling time intervals. Thus, the transmission time period may be determined at intervals during the transmission time period, taking into account the ions detected during the most recent sampling time interval. Beneficially, this allows the transmission time to accurately reflect any change or variation of the ion current with time. Fluctuations in the ion current (which would consequently change the filling rate of the ion trap) can be taken into account.

The time difference between the start of a sampling time interval and the start of an immediately subsequent sampling time interval represents a sampling period and therefore is related to the sampling frequency (which is the reciprocal of the sampling period). A sampling frequency faster than the frequency of any fluctuation or variation in the ion current allows changes in the ion current with time to be measured and monitored. In particular, the time difference (or sampling period) is the time between each distinct sampling time interval, and so is related to how often the ion current is sampled. A smaller time difference results in a higher frequency of sampling of the ion current.

The timescale of variation of the ion current can be quantified in various ways, as discussed below. Nevertheless, the skilled person will understand that it represents the period of time over which the ion current undergoes a significant change in its magnitude. Ideally, to obtain an accurate indication of changes in the ion current, the time difference (or sampling period) should be small compared the timescale of variation of the sampling current. This means a large number of samples of the ion current are measured over the period of time during which the ion current undergoes significant change.

The source of ions is a component from which ions are transmitted towards the ion trap. In some cases, the source of ions is an ion source (for example, an electrospray ionisation source (ESI) or a matrix-assisted laser desorption/ionization ion source (MALDI)). However, in other cases the source of ions is a component which emits ions that have been generated elsewhere (for example, an ion guide).

Preferably, setting the duration of the transmission time period based on the detection of ions at the ion detector comprises setting the transmission time period based on the total quantity of ions detected at the ion detector during the plurality of sampling time intervals. The total quantity or number of ions received at the ion detector during the plurality of sampling time intervals indicates the filling rate (number of ions per unit of time) received at the ion trap. Due to the fluctuation or variation in the ion current with time, this filling rate varies across the plurality of sampling time intervals. The quantity or number of ions received at the ion detector during each sampling time interval is representative of the ion current at that interval of time. As an alternative to the total quantity or number of ions received at the ion detector, the ion current or population of ions detected at the ion detector could be used during the plurality of sampling time intervals. This would take into account the species of ion, for example.

Preferably, the time difference between the start of a sampling time interval and the start of an immediately subsequent sampling time interval (the sampling period) is less than a predefined percentage of the timescale for variation of the magnitude of the ion current. Preferably, the time difference (or sampling period) is significantly less than the timescale for variation of the magnitude of the ion current. The predefined percentage should be chosen such that sampling of the ion current is sufficiently fast to accurately capture the change in the ion current. For instance, the time difference or sampling period can be set as less than 50% of the timescale for variation of the ion current. More preferably, the time difference can be set as less than 20% of the timescale for variation of the ion current, or more preferably less than 10%, or even less than 5%. The time difference may be in the range 1% to 50%. A larger percentage may be suitable where the variation in the ion current has a relatively stable periodicity. Nevertheless, if the variation in the ion current is less stable, a smaller predefined percentage may be used. Use of a smaller predefined percentage results in a greater number of samples of the ion current within the given timescale for variation of the ion current, and so a more accurate representation of the variation in the ion current can be obtained. Generally, the larger the change observed in the ion current, the smaller the predefined percentage that may be used (in other words, the more frequent the sampling that may be used). In an illustrative example, for an ion current demonstrating fluctuations of ±100% of its average magnitude, the time difference (or sampling period) could be chosen as 10% or even less of the timescale for variation of the magnitude of the ion current. However, where the ion current demonstrates smaller fluctuations of only ±20-30% of its average magnitude, to obtain the required quantitative accuracy then a longer time difference (or sampling period) may be chosen, such as a predefined percentage of 20% of the timescale for variation of the magnitude of the ion current.

Optionally, the timescale for variation of the magnitude of the ion current is the average period of the current variation. For instance, the ion current may vary approximately periodically. This may especially be the case where a pulsed ion source is used, for example a MALDI source.

Optionally, the timescale for variation of the magnitude of the ion current is the average rise- or fall-time of peaks in the current. For instance, this measure of the timescale for variation may be especially useful when the ion current varies approximately periodically.

Optionally, the timescale for variation of the magnitude of the ion current is determined by a transform of the ion current to the frequency domain. For example, a Fourier transform of the fluctuating ion current to the frequency domain could be used, and the relevant timescale could be analysed by considering the components of the ion current in the frequency domain. For instance, the timescale of current variation may be the period equal to the reciprocal of the frequency of a peak in the Fourier transform of the ion current to the frequency domain. For example, the highest frequency peak having at least a predetermined amplitude in the Fourier transform, could be used.

Optionally, the timescale for variation of the magnitude of the ion current is the average time period in which the ion current changes by at least a predetermined percentage of its maximum magnitude. For instance, the timescale for variation of the magnitude of the ion current is the average time period in which the ion current decreases by 20% of its maximum value. Different percentages of the maximum value could be selected.

Optionally, the timescale for variation of the magnitude of the ion current is the average time difference between instances of the ion current being equal to the moving average magnitude of the ion current. In other words, if the ion current moves above and below the moving mean average (or rolling mean average) of the ion current, the time scale for variation can be the average time between instances when the ion current is equal to the moving average. The mean or median average of the time between instances could be used.

A time base or window for the moving average should be selected to be appropriate to the ion source, ion optics and analyser used, for instance according to the requirements outlined elsewhere in the description below, and typically lying in the millisecond range (for instance, 0.1 to 100 ms, and more preferably 0.5 to 10 ms). In particular, the base for the moving average must be shorter than: (a) the average duration of ion accumulation prior to a scan, and/or (b) the duration of the scan (the transmission time period), and/or (c) the duration over which any voltages on the ion optics are kept constant (while for simple DC ion optics this duration may be short, down to several microseconds, for more accurate devices like a quadrupole mass filter, it could reach up to 1-2 ms). Nevertheless, the base for the moving average needs to be longer than (and preferably much longer than, such as at least 2×, 5× or 10× longer than): (a) the temporal broadening during collisional cooling (typically 0.2-1 ms), and/or (b) the minimum gating time of the ion optics (or split or dual gate) arranged for injection of ions into ion trap analysers (for instance a linear ion trap or Orbitrap™ analyser) (typically in the range 0.02-0.1 ms), and/or (c) the average settling time of voltages on the ion optics (typically in the range 0.01-1 ms)—for instance this could be the gating time of the ion optics controlling the described method.

Optionally, the magnitude of the ion current may vary approximately stepwise. In this case, the timescale for variation of the magnitude of the ion current may be the average width of peaks in the derivative of the ion current against time. The average width of peaks may be the average full-width, half-maxima of the peaks in the derivative of the ion current.

In another example, the timescale for variation of the magnitude of the ion current may be the time lag for the ion current associated with an autocorrelation value of more than or equal to a pre-defined value. For instance, the timescale of variation may be the time lag between instances of the ion current having an autocorrelation value of more than 0.5, or more preferably of more than 0.7. Other autocorrelation values could be used, however. As will be understood by the person skilled in the art, the autocorrelation value describes the measure of correlation (or similarity) between two observations of a parameter as a function of the time lag between them. Accordingly, autocorrelation can be used to identify repeating patterns in a signal, including a periodic signal obscured by noise.

Preferably, prior to detecting at the ion detector at least some ions from the source of ions during a plurality of distinct sampling time intervals, the method further comprises receiving a measurement of the ion current over a pre-measurement time period, and determining the timescale for variation of the magnitude of the ion current over the pre-measurement time period. In other words, a pre-experiment is performed to characterise the ion current and the timescale for variation of the ion current, prior to any filling of the ion trap. The time scale for variation of the ion current measured during the pre-experiment may be determined according to any of the measures described above. The time difference between the start of a sampling time interval and the start of an immediately subsequent sampling time interval (sampling period) can then be based on the time scale for variation of the ion current so determined.

In some examples, the time difference between the start of a sampling time interval and the start of an immediately subsequent sampling time interval or sampling period may be no greater than 1 ms and preferably less than 1 ms, such as between 10 μs and 1000 μs, and preferably between 10 μs and 500 μs, and more preferably between 10 μs and 200 μs, e.g. 50 μs to 200 μs. In most cases, the time difference could be in the range 1 μs to 1000 μs Ideally, the duration of each sampling time interval of the plurality of sampling time intervals is less than 20 μs, and preferably less than 10 μs. However, the sampling time interval could be any suitable period in view of the length of the transmission time period. In most cases, the sampling time intervals will be within the range 50 μs to 1 μs. In most cases, the sampling time intervals will be equal throughout the transmission time period, but this is not necessarily required. For example, the duration of the sampling time interval could change dynamically, dependent on the quantity of ions detected at the ion detector in a previous sampling time interval.

Preferably, the total of the plurality of sampling time intervals is less than 20% of the transmission time period, and preferably less than 10% of the transmission time period. The total of the plurality of the sampling time intervals can be any percentage of the transmission time period, selected to provide a representative sample of the ions supplied from the ion source. If the ion detector receives and detects the full ion beam during the sampling time intervals, the percentage of the total of the plurality of sampling time intervals compared to the transmission time period may be approximately representative of the percentage of the total ions transmitted from the source and received at the ion detector compared to the ion trap.

The method may further comprise providing at least one ion detector along the ion path, between the source of ions and the ion trap, which preferably acts as an independent charge detector. In one example, the ion detector resides on the ion path. The ion detector may be a grid detector, which allows at least some ions to pass through the grid and onwards on the ion path to the ion trap. Alternatively, the ion detector may be a non-destructive ion detector such as an image charge detector.

Preferably, detecting at an ion detector at least some ions from the source of ions during a plurality of distinct sampling time intervals comprises, prior to detecting the at least some ions, directing the at least some ions from the ion path towards the ion detector during each distinct sampling time interval. In other words, the ion detector is an auxiliary ion detector, which is not on the ion path. Ions are directed (or deflected) off the ion path, e.g. using pulsed deflection, towards the detector prior to reaching the ion trap. Ions are directed away from the ion path towards the detector by use of suitable ion optics. The deflection is intermittent, only occurring during each distinct sampling time interval. Although use of an additional ion detector to intermittently detect the ion current has been demonstrated in US Patent Publication No. US 2016/217985, this is for the purpose of combining the detector signal with the mass spectrum in order to provide an improved abundance measurement. It does not relate to automatic gain control (and more specifically, to controlling the filling of an ion trap with a predetermined quantity of ions), and does not consider setting the duration of any time period as a result of the measured detection signal.

The method may further comprise providing the ion detector external to the ion path, providing at least one switching device along the ion path, arranged between the source of ions and the ion trap, and wherein the switching device is configured to direct ions from the source of ions towards the ion detector external to the ion path during each distinct sampling time interval. In this example, the ion detector is not arranged directly on the ion path, but is an auxiliary ion detector arranged close to, but spaced apart from the ion path. Ions from the source of ions may be directed (or deflected) from the ion path and toward the ion detector by use of suitable ion optics. For instance, ion optics arranged on the ion path between the source of ions and the ion trap can be used to redirect ions to the ion detector, by application of suitable voltages at the ion optics. Accordingly, the ion optics can be used to intermittently deflect ions from the ion path to the ion detector during each sampling time interval.

Preferably, the method further comprises terminating the transmission of ions along the ion path once the transmission period has elapsed. In other words, filling of the ion trap can be stopped or halted once the transmission time has elapsed. In some examples, terminating the transmission of the ions along the ion path comprises interrupting the supply of ions along the ion path. Interrupting the supply of ions along the ion path may comprise at least one of: shutting down the source of ions; modulating the source of ions; or blocking transmission of ions from the source of ions to the ion trap. In other words, the ions from the ion source are prevented from reaching and entering the ion trap, in order to prevent further filling of the ion trap.

Terminating the transmission of ions along the ion path may comprise direction of all ions away from the ion path prior to the ion trap. In other words, ions may be deflected from the ion path, prior to the ion trap, such that the ions do not reach the ion trap. The deflection may be achieved by applying suitable voltages at ion optics, the ion optics arranged on the ion path between the source of ions and the ion trap.

In some examples, to terminate transmission of the ions, the ions are directed from the ion path towards an ion dump. In some cases, the ion optics used for directing the ions in this way can be the previously described switching device, used to deflect ions to the ion detector during the sampling time intervals. In this case, the deflection of ions to either the ion detector or to the ion dump can be selected by application of suitable voltages to change the extent of the deflection of the ions.

Preferably, setting the duration of the transmission time period comprises terminating the transmission of ions along the ion path when a total quantity of ions detected at the ion detector during the plurality of sampling time intervals exceeds a pre-defined value. In other words, the transmission of ions is terminated once a predefined number of ions have been received at the ion detector. In particular, the number of ions received at the ion detector during a total sampling time is indicative of the number of ions received at an ion trap during the transmission time period.

At least one gas-filled ion guide may be provided along the ion path, between the source of ions and the ion trap. The ion guide may be used to converge or focus ions to an ion beam traversing the ion path. Thus the ion guide assists in the transport of ions along the ion path. Nevertheless, ions travelling through the gas-filled ion guide may undergo collisions with the gas atmosphere. Consequent diffusion of the ions causes different ions within the ion beam to have a slightly differing trajectory and velocity. This affects the time taken for ions to move through the ions guide and traverse the ion path. As a result, variation in the ion current incoming to the ion guide may be 'smoothed' by the effects of such diffusional broadening.

For instance, stepwise changes in the incoming ion current can be broadened or smoothed. This would be reflected in a broadening of the representative peak in the derivative of the ion current exiting the ion guide with time. The broadening of the peak can provide a timescale for the variation of the ion current. For instance, the time difference or sampling period between the start of a sampling time interval and the subsequent sampling time interval may be less than the average full-width half maxima of peaks in the derivative of the ion current with time. Therefore, the timescale for variation of the magnitude of the ion current is less than temporal broadening of step changes in the magnitude of an ion current entering the gas-filled ion trap, resulting from ion collisions with gas in the gas-filled guide.

In another example using a gas-filled ion guide prior to the trap and the detector, a gas-filled RF ion guide of length L contains gas a pressure P so that $P \times L > 0.2$ mbar mm. In this example, a pulsed ion current is arranged to enter the ion guide from the source of ions, wherein each pulse can be represented by a near delta-function. Upon entering the ion guide the current pulses undergo diffusional broadening such that each pulse has a width of around 200-500 μs. Consequently, the time difference or sampling period between the start of a sampling time interval and the subsequent sampling time interval must be less, and preferably much less, than the pulse width. In this example, the time difference may be set as 100 μs.

Ideally, the method may be used to provide mass analysis of a sample. As such, the described method may further comprise introducing ions derived from the ions accumulated at the ion trap into a mass analyser or an ion mobility analyser. Ions accumulated at the ion trap may be injected into a mass analyser to undergo an analytical scan, using techniques known in the art. Any type of mass analyser may be used.

In some examples, the ions are introduced into the mass analyser or the ion mobility analyser after elapse of the transmission time period. For instance, the ions are injected into the mass analyser only after the predefined quantity of ions is accumulated in the ion trap. Alternatively, some ions may be injected from the ion trap before the transmission time period has elapsed, such that filling of the ion trap continues even whilst ions are ejected from the ion trap to the mass analyser.

The ion source may provide ions in the form of a continuous, a quasi-continuous or a pulsed ion beam. Examples of ion source include: an electrospray ionisation source (ESI) or especially MALDI source. Ion source could also include any number of ion optical elements transmitting ions, e.g. one or more RF ion guides, lenses, ion traps, etc.

Preferably, the mass analyser is an orbital trapping mass analyser, and the ion trap is a linear ion trap, for example a curved ion trap (C-trap), arranged prior to the orbital trapping mass analyser. In particular, the method can be used within an Orbitrap™ mass analyser. Nevertheless, it will be understood that the method is applicable for use with any type of mass analyser within any type of mass spectrometer.

In a second aspect, there is described a controller for controlling the filling of an ion trap with a predetermined quantity of ions, the controller configured to:

- receive a measurement based on a quantity of ions detected at an ion detector during a plurality of distinct sampling time intervals, the ions transmitted from a source of ions, wherein an ion path extends from the source of ions to an ion trap such that ions are accumulated at the ion trap over a transmission time period, wherein ions transmitted along the ion path generate an ion current and the magnitude of the ion current varies in time, and wherein the plurality of distinct sampling time intervals interspersed within the transmission time period; and
- set the duration of the transmission time period based on the ions detected at the ion detector; and
- wherein the time difference between the start of a sampling time interval and the start of an immediately subsequent sampling time interval is less than the timescale for variation of the magnitude of the ion current.

In other words, the controller is configured to control and/or execute the method described above. For instance, the controller may be configured to control the source of ions, such that ions are supplied to the ion path, and transmitted along the ion path during the transmission time period. The controller may be further configured to intermittently sample the ion current, by detecting ions at the ion detector for a plurality of sampling time intervals within the transmission time period. The controller may further set the duration of the transmission time period according to the measurement of the detected ions received from the ion detector.

In a particular example, the controller may be configured to set the duration of the transmission time period based on the total quantity of ions detected at the ion detector during the plurality of sampling time intervals. This may utilise a predefined algorithm to estimate the filing time of the ion trap from a determined rate of ions received at the ion detector within the total of the previous sampling time intervals. It is noted that the total quantity of ions can be represented either by a charge density or an ion density. A proportion of the ion beam that is detected by the ion detector can be determined, for example from previous filling experiments and/or from the duration of the sampling intervals.

Preferably, the controller is configured to set the duration of the sampling time interval. As such, the controller can be used to set the percentage of ions supplied by the source of ions to the ion path that are received at the ion detector compared to the ion trap.

Preferably, the controller is configured to set the time difference between the start of a sampling time interval and the start of an immediately subsequent sampling time interval. Specifically, the controller can set the time difference to be less than the timescale of variation of the ion current. In some cases, the timescale of variation of the ion current will be known. In other examples, the controller may determine the timescale of variation of the ion current by executing a pre-experiment prior to the beginning of the transmission time period.

Preferably, the controller is configured to set the time difference between the start of a sampling time interval and the start of an immediately subsequent sampling time interval to be less than a predefined percentage of the timescale for variation of the magnitude of the ion current. For instance, the time difference may be set as less than 50% of the timescale for variation of the ion current, or less than 20% of the timescale for variation of the ion current, or even less than 10% the timescale for variation of the ion current. The pre-defined percentage may be in the range 1% to 50%. The predefined percentage may determine the number of samples of the ion current obtained within the timescale of variation of the ion current. Therefore, the predefined percentage may also determine how accurately the variation in the ion current is monitored, and so how precisely the transmission time period can be predicted in order to avoid overfilling of the ion trap. In general, a more precise determination of the transmission time period will be obtained by more frequent sampling of the ion current (and so a smaller predefined percentage). However, more frequent sampling of the ion current will also in most cases increase the proportion of ions received at the ion detector compared to the ion trap, so increasing the time for filling the ion trap.

A number of measures for the timescale of variation of the ion current can be used, for instance:

- Optionally, the timescale for variation of the magnitude of the ion current is the average period of the current variation.
- Optionally, the timescale for variation of the magnitude of the ion current is determined based on a transform of the ion current to the frequency domain. For example, a Fourier transform to the frequency domain could be used.
- Optionally, the timescale for variation of the magnitude of the ion current is the average time period in which the ion current changes by at least a predetermined percentage of its maximum magnitude.
- Optionally, the timescale for variation of the magnitude of the ion current is the average time difference between instances of the ion current being equal to the moving average magnitude of the ion current. The time base or window for the moving average should be selected to be appropriate to the ion source, ion optics and analyser used, for instance according to the requirements outlined elsewhere above and in the description below.
- Optionally, the magnitude of the ion current varies approximately stepwise, and the timescale for variation of the magnitude of the ion current is the average width of peaks in the derivative of the ion current against time.

Preferably, the controller, prior to receiving the measurement based on a quantity of ions detected at an ion detector during the plurality of distinct sampling time intervals, is further configured to receive a measurement of the ion current during a pre-measurement time period, and determine the timescale for variation of the magnitude of the ion current during the pre-measurement time period. In other words, the controller is configured to undertake a 'pre-measurement' of the ion current, in order to establish the timescale for variation of the ion current. This pre-measurement may include measurement of the ion current at an ion detector for a predefined period of time, and then analysis of the measured ion current to determine a timescale for variation of the ion current according to one of the measures described above. The ion detector may be the same ion detector as used to detect ions during the sampling time intervals, or may be a different, separate ion detector.

In an alternative, the timescale for variation of the ion current may already be known as a result of earlier experiments or measurements, or simply by prior knowledge of the characteristics of the source of ions. Thus, the described 'pre-measurement' is not an essential step.

Preferably, the time difference between the start of a sampling time interval and the start of an immediately subsequent sampling time interval is between 10 μs and 1000 μs, and preferably between 10 μs and 500 μs, and more preferably between 10 μs and 200 μs, e.g. 50 μs to 200 μs. The time difference may be in the range of 1 to 1000 μs. The time difference defines the sampling frequency of the ion current. Advantageously, the ion current is sampled with a frequency large enough to sufficiently capture any variation or changes in the ion current.

Preferably, the duration of each sampling time interval of the plurality of sampling time intervals is less than 20 μs, and preferably less than 10 μs. The sampling time intervals may be anywhere in the range of 1 μs to 100 μs. The sampling time interval can be selected, in comparison to the transmission time period, in order that an approximate percentage of ions are received at the ion detector versus the percentage of ions received at the ion trap.

Preferably, the total of the plurality of sampling time intervals is less than 20% of the transmission time period, and more preferably less than 10% of the transmission time period. The total of the plurality of sampling time intervals may be between 1 and 50% of the transmission time period. The percentage of the total of the plurality of sampling time intervals compared to the transmission time intervals may determine the proportion of ions from the ions source received at the ion detector compared to the ion trap.

Preferably, the ion detector is arranged external to the ion path, and the controller is further configured to control a switching device arranged along the ion path between the source of ions and the ion trap, the switching device configured to direct ions from the source of ions to the ion detector, and wherein the controller is configured to control the switching device to direct ions from the source of ions towards the ion detector external to the ion path during each distinct sampling time interval. In other words, the ion detector is an auxiliary ion detector, arranged close to, but not on, the ion path. A switching device (for instance, suitable ion optics) can be arranged on the ion path, between the source of ions and the ion trap. Upon application of suitable voltages at the switching device, the ions can be deflected (or directed) from the ion path and toward the ion detector. Specifically, deflection from the ion path takes place intermittently and under control of the detector, such that ions are received at the ion detector during each sampling time interval. Outside of the sampling time intervals but during the transmission time period, the ions continue along the ion path to be received at the ion trap.

In some embodiments, the ion detector resides on the ion path. The ion detector may be a grid detector, which allows at least some ions to pass through the grid and onwards on the ion path to the ion trap. Alternatively, the ion detector may be a non-destructive ion detector such as an image charge detector. In such embodiments, a continuous detection of a part of the ion beam by the ion detector is achieved.

Preferably, the controller is configured to terminate the transmission of ions along the ion path once the transmission time period has elapsed. This may comprise the controller interrupting the supply of ions along the ion path, for example by performing at least one of: shutting down the source of ions; modulating the source of ions; or actuating a shutter to block transmission of ions from the source of ions to the ion trap.

The controller may be configured to terminate the transmission of ions along the ion path by controlling an ion gate (or suitable ion optics) arranged along the ion path between the source of ions and the ion trap. The controller may be configured to control the ion gate so as to direct (or deflect) all ions from the ion path prior to the ion trap. As such, the deflected ions do not reach to ion trap, and will not contribute to the filling of the ion trap.

In some examples, the ion gate is the switching device described above to deflect ions to the ion detector during the sampling time intervals. To terminate transmission of ions along the ion path the controller may be configured to control the switching device to direct all ions from the ion path and towards an ion dump. In other words, the switching device may be arranged such that under application of a first set of voltages, the ions are deflected from the ion path to the ion detector, but under application of a second set of voltages the ions are deflected from the ion path to the ion dump. Where a third set of voltages are applied at the switching device (which may be zero voltages) the ions are not deflected, and instead continue along the ion path to the ion trap.

Preferably, the controller is configured to set the duration of the transmission time period based on the total quantity of ions detected at the ion detector during the sampling time intervals. This may comprise the controller being configured to terminate the transmission of ions along an ion path when the measurement of the total quantity of ions detected at the ion detector exceeds a pre-defined value. In other words, the controller prevents ions from being received at the ion trap after a predetermined quantity of ions has been detected at the ion detector during the sampling time intervals. In particular, the controller may sum the quantity of ions detected by the ion detector during each of the plurality of sampling time intervals, and compare this total quantity of ions to a pre-defined value.

Preferably, the controller is further configured to control the introduction of ions derived from the ions accumulated at the ion trap into a mass analyser or an ion mobility analyser. In other words, the ions stored in the ion trap may be injected into a mass analyser to perform an analytical scan, under control of the controller. The ions may be introduced into the mass analyser or the ion mobility analyser after elapse of the transmission time period. Alternatively, the controller may control the injection of a portion of ions from the ion trap into a mass analyser, even as filling of the ion trap takes place (in other words, during the transmission time period).

In a preferred example, the mass analyser is an orbital trapping mass analyser, and the ion trap is a curved ion trap arranged prior to the orbital trapping mass analyser. For instance, the controller may be incorporated into an orbital trapping mass analyser, such as an Orbitrap™ mass analyser.

In a third aspect, there is described a mass spectrometer comprising:

- a source of ions;
- an ion trap, arranged to receive ions transmitted along an ion path extending from the source of ions to the ion trap;
- an ion detector arranged to be capable of detecting at least some ions from the source of ions;
- a mass analyser, arranged to receive at least some ions from the ion trap; and
- a controller as described above.

In other words, a mass spectrometer may incorporate a controller configured to control the described method.

Preferably, the ion detector is external to the ion path, and the mass spectrometer further comprises an ion gate arranged along the ion path between the source of ions and the ion trap, the ion gate capable of directing ions from the source of ions towards the ion detector external to the ion path. In other words, the mass spectrometer incorporates ion optics to intermittently deflect the ion beam, towards an auxiliary ion detector, arranged external to the ion path. In this way, the mass spectrometer and incorporated controller can carry out the above-described method whereby ions are deflected from the ion path during the plurality of sampling time intervals. In some embodiments, the ion gate (or ion optics) can further be used to deflect or direct the ions from the source of ions to an ion dump after the transmission time period has elapsed.

As will be understood by the person skilled in the art, the mass spectrometer may be of a number of different types. For instance, the mass spectrometer may be an orbital-trapping mass spectrometer, a time-of-flight mass spectrometer, a quadrupole mass spectrometer or an ion cyclotron resonance mass spectrometer.

With respect to the method, the controller or the mass spectrometer described above, the ion trap may be any one of: a radio frequency trap, a Penning trap, an electrostatic trap, a time of flight trap, a linear trap, which may be, for example, a rectilinear or curved trap.

With respect to the method, the controller or the mass spectrometer described above, the source of ions may be any one of: an ion trap, a ion source, an electrospray ionisation source (ESI), matrix-assisted laser desorption/ionization ion source (MALDI), an atmospheric pressure chemical ionisation (APCI) source, an atmospheric pressure photo-ionisation (APPI) source, an atmospheric pressure photo-chemical-ionisation (APPCI) source, an electron impact ionisation source, a fast ion bombardment source, a secondary ion (SIMS) source, a mass analyser, an ion mobility analyser.

With respect to the method, the controller or the mass spectrometer described above, the ion detector may be any one of: a Faraday cup, a single-ion detector, a secondary electron multiplier.

The following consistory clauses provide further illustrative examples:

1. A method for controlling the filling of an ion trap with a predetermined quantity of ions, the method comprising:
   - generating a ion current by transmitting ions along an ion path, the ion path extending from a source of ions to an ion trap such that ions are accumulated in the ion trap over a transmission time period, wherein the magnitude of the ion current varies in time;
   - detecting at an ion detector at least some ions from the source of ions during a plurality of distinct sampling time intervals interspersed within the transmission time period;
   - setting the duration of the transmission time period based on the detection of ions at the ion detector; and
   - wherein the time difference between the start of a sampling time interval and the start of an immediately subsequent sampling time interval is less than a timescale for variation of the magnitude of the ion current.
2. The method of clause 1, wherein setting the duration of the transmission time period based on the detection of ions at the ion detector comprises setting the transmission time period based on the total quantity of ions detected at the ion detector during the plurality of sampling time intervals.

3. The method of clause 1 or clause 2, wherein the time difference between the start of a sampling time interval and the start of an immediately subsequent sampling time interval is less than a predefined percentage of the timescale for variation of the magnitude of the ion current.
4. The method of clause 3, wherein the predefined percentage is one of: 10%, 20%, 50%, or 90%.
5. The method of any preceding clause, wherein the timescale for variation of the magnitude of the ion current is an average period of the current variation.
6. The method of any one of clauses 1 to 4, wherein the timescale for variation of the magnitude of the ion current is determined based on a transform of the ion current to the frequency domain.
7. The method of any one of clauses 1 to 4, wherein the timescale for variation of the magnitude of the ion current is the average time period in which the ion current changes by at least a predetermined percentage of its maximum magnitude.
8. The method of any one of clauses 1 to 4, wherein the timescale for variation of the magnitude of the ion current is the average time difference between instances of the ion current being equal to the moving average magnitude of the ion current.
9. The method of any one of clauses 1 to 4, wherein the magnitude of the ion current varies approximately stepwise, and the timescale for variation of the magnitude of the ion current is the average width of peaks in the derivative of the ion current against time.
10. The method of any preceding clause, wherein the method further comprises, prior to detecting at the ion detector at least some ions from the source of ions during a plurality of distinct sampling time intervals, steps of:
    receiving a measurement of the ion current over a pre-measurement time period; and
    determining the timescale for variation of the magnitude of the ion current over the pre-measurement time period.
11. The method of any preceding clause, wherein the time difference between the start of a sampling time interval and the start of an immediately subsequent sampling time interval is between 10 μs and 1000 μs, and preferably between 10 μs and 500 μs, and more preferably between 10 μs and 200 μs.
12. The method of any preceding clause, wherein the duration of each sampling time interval of the plurality of sampling time intervals is less than 20 μs, and preferably less than 10 μs.
13. The method of any preceding clause, wherein the total of the plurality of sampling time intervals is less than 20% of the transmission time period, and preferably less than 10% of the transmission time period.
14. The method of any preceding clause, further comprising:
    providing at least one ion detector along the ion path, between the source of ions and the ion trap.
15. The method of any one of clauses 1 to 14, wherein detecting at an ion detector at least some ions from the source of ions during a plurality of distinct sampling time intervals comprises, prior to detecting the at least some ions, directing the at least some ions from the ion path towards the ion detector during each distinct sampling time interval.
16. The method of clause 15, further comprising:
    providing the one ion detector external to the ion path;
    providing at least one switching device along the ion path, arranged between the source of ions and the ion trap;
    wherein the switching device is configured to direct ions from the source of ions towards the ion detector external to the ion path during each distinct sampling time interval.
17. The method of any preceding clause, further comprising:
    terminating the transmission of ions along the ion path once the transmission period has elapsed.
18. The method of clause 17, wherein terminating the transmission of the ions along the ion path comprises interrupting the supply of ions along the ion path.
19. The method of clause 18, wherein interrupting the supply of ions along the ion path comprises at least one of: shutting down the source of ions; modulating the source of ions; or blocking transmission of ions from the source of ions to the ion trap.
20. The method of clause 17, wherein terminating the transmission of ions along the ion path comprises direction of all ions from the ion path prior to the ion trap.
21. The method of clause 20 when dependent on clause 16, wherein the switching device is further configured to direct ions from the source of ions towards an ion dump.
22. The method of any preceding clause, wherein setting the duration of the transmission time period comprises terminating the transmission of ions along the ion path when a total quantity of ions detected at the ion detector during the plurality of sampling time intervals exceeds a pre-defined value.
23. The method of any preceding clause, further comprising:
    providing at least one gas-filled ion guide along the ion path, between the source of ions and the ion trap.
24. The method of clause 23, when dependent on clause 1 to 3, or clauses 10 to 23, wherein the timescale for variation of the magnitude of the ion current is less than a temporal broadening of step changes in the magnitude of an ion current entering the gas-filled ion trap, resulting from ion collisions with gas in the gas-filled guide.
25. The method of any preceding clause, further comprising:
    introducing ions derived from the ions accumulated at the ion trap into a mass analyser or an ion mobility analyser.
26. The method of clause 25, wherein the ions are introduced into the mass analyser or the ion mobility analyser after elapse of the transmission time period.
27. The method of clause 25 or 26, wherein the mass analyser is an orbital trapping mass analyser, and the ion trap is a curved ion trap arranged prior to the orbital trapping mass analyser.
28. A controller for controlling the filling of an ion trap with a predetermined quantity of ions, the controller configured to:
    receive a measurement based on a quantity of ions detected at an ion detector during a plurality of distinct sampling time intervals, the ions transmitted from a source of ions, wherein an ion path extends from the source of ions to an ion trap such that ions are accumulated at the ion trap over a transmission time period, wherein ions transmitted along the ion path generate an ion current and the magnitude of the ion current varies in time, and wherein the plurality of distinct sampling time intervals interspersed within the transmission time period; and set the duration of the transmission time period based on the ions detected at the ion detector; and wherein the time difference between the start of a sampling time interval and the start of an immediately subsequent sampling time interval is less than the timescale for variation of the magnitude of the ion current.

29. The controller of clause 28, wherein the controller is configured to set the duration of the transmission time period based on the total quantity of ions detected at the ion detector during the plurality of sampling time intervals.

30. The controller of clause 28 or clause 29, wherein the controller is further configured to:

set the duration of the sampling time interval.

31. The controller of any one of clauses 28 to 30, further configured to: set the time difference between the start of a sampling time interval and the start of an immediately subsequent sampling time interval.

32. The controller of clause 31, further configured to:

set the time difference between the start of a sampling time interval and the start of an immediately subsequent sampling time interval to be less than a predefined percentage of the timescale for variation of the magnitude of the ion current.

33. The controller of clause 32, wherein the predefined percentage is one of: 10%, 20%, 50%, or 90%.

34. The controller of any one of clauses 28 to 33, wherein the timescale for variation of the magnitude of the ion current is the average period of the current variation.

35. The controller of any one of clauses 28 to 33, wherein the timescale for variation of the magnitude of the ion current is determined based on a transform of the ion current to the frequency domain.

36. The controller of any one of clauses 28 to 33, wherein the timescale for variation of the magnitude of the ion current is the average time period in which the ion current changes by at least a predetermined percentage of its maximum magnitude.

37. The controller of any one of clauses 28 to 33, wherein the timescale for variation of the magnitude of the ion current is the average time difference between instances of the ion current being equal to the moving average magnitude of the ion current.

38. The controller of any one of clauses 28 to 33, wherein the magnitude of the ion current varies approximately stepwise, and the timescale for variation of the magnitude of the ion current is the average width of peaks in the derivative of the ion current against time.

39. The controller of any one of clauses 28 to 38, wherein prior to receiving the measurement based on a quantity of ions detected at an ion detector during the plurality of distinct sampling time intervals, the controller is further configured to:

receive a measurement of the ion current during a pre-measurement time period; and determine the timescale for variation of the magnitude of the ion current during the pre-measurement time period.

40. The controller of any one of clauses 28 to 39, wherein the time difference between the start of a sampling time interval and the start of an immediately subsequent sampling time interval is between 10 μs and 1000 μs, and preferably between 10 μs and 500 μs, and more preferably between 10 μs and 200 μs.

41. The controller of any one of clauses 28 to 40, wherein the duration of each sampling time interval of the plurality of sampling time intervals is less than 20 μs, and preferably less than 10 μs.

42. The controller of any one of clauses 28 to 41, wherein the total of the plurality of sampling time intervals is less than 20% of the transmission time period, and preferably less than 10% of the transmission time period.

43. The controller of any one of clauses 28 to 42, wherein the ion detector is arranged external to the ion path, the controller further configured to:

control a switching device arranged along the ion path between the source of ions and the ion trap, the switching device configured to direct ions from the source of ions to the ion detector;

wherein the controller is configured to control the switching device to direct ions from the source of ions towards the ion detector external to the ion path during each distinct sampling time interval.

44. The controller of any one of clauses 28 to 43, further configured to: terminate the transmission of ions along the ion path once the transmission period has elapsed.

45. The controller of clause 44, wherein terminating the transmission of the ions along the ion path comprises interrupting the supply of ions along the ion path.

46. The controller of clause 45, wherein interrupting the supply of ions along the ion path comprises the controller configured to perform at least one of: shutting down the source of ions; modulating the source of ions; or actuating a shutter to block transmission of ions from the source of ions to the ion trap.

47. The controller of clause 44, wherein the controller configured to terminate the transmission of ions along the ion path comprises the controller configured to:

control an ion gate arranged along the ion path between the source of ions and the ion trap, the controller configured to control the ion gate so as to direct all ions from the ion path prior to the ion trap.

48. The controller of clause 47, when dependent on clause 43, wherein the ion gate is the switching device, and wherein to terminate transmission of ions along the ion path the controller is configured to:

control the switching device to direct all ions from the ion path and towards an ion dump.

49. The controller of any one of clauses 28 to 48, wherein the controller configured to set the duration of the transmission time period based on the total quantity of ions detected at the ion detector during the sampling time intervals comprises the controller configured to terminate the transmission of ions along an ion path when the measurement of the total quantity of ions detected at the ion detector exceeds a pre-defined value.

50. The controller of any one of clauses 28 to 49, the controller further configured to:

control the introduction of ions derived from the ions accumulated at the ion trap into a mass analyser or an ion mobility analyser.

51. The controller of clause 50, wherein the ions are introduced into the mass analyser or the ion mobility analyser after elapse of the transmission time period.

52. The controller of clause 50 or clause 51, wherein the mass analyser is an orbital trapping mass analyser, and the ion trap is a curved ion trap arranged prior to the orbital trapping mass analyser.

53. A mass spectrometer comprising:
a source of ions;
an ion trap, arranged to receive ions transmitted along an ion path extending from the source of ions to the ion trap;
an ion detector arranged to be capable of detecting at least some ions from the source of ions;
a mass analyser, arranged to receive at least some ions from the ion trap; and
a controller according to any one of clauses 28 to 52.

54. The mass spectrometer of clause 53, wherein the ion detector is external to the ion path, the mass spectrometer further comprising:
an ion gate arranged along the ion path between the source of ions and the ion trap, the ion gate capable of directing ions from the source of ions towards the ion detector external to the ion path.

55. The mass spectrometer of clause 53 or clause 54, wherein the ion trap is one of: a radio frequency trap, a Penning trap, an electrostatic trap, a time of flight trap, a curved trap.

56. The mass spectrometer of any one of clauses 53 to 55, wherein the source of ions is one of: an ion trap, a ion source, an electrospray ionisation source (ESI), matrix-assisted laser desorption/ionization ion source (MALDI), a mass analyser, an ion mobility analyser.

57. The mass spectrometer of any one of clauses 53 to 56, wherein the ion detector is one of: a Faraday cup, a single-ion detector, secondary electron multiplier.

LIST OF FIGURES

The present invention will now be described, by way of example only, with reference to the accompanying drawings, in which.

In the drawings, like parts are denoted by like reference numerals. The drawings are not drawn to scale.

DETAILED DESCRIPTION OF SPECIFIC EMBODIMENTS OF THE INVENTION

Figure 1:
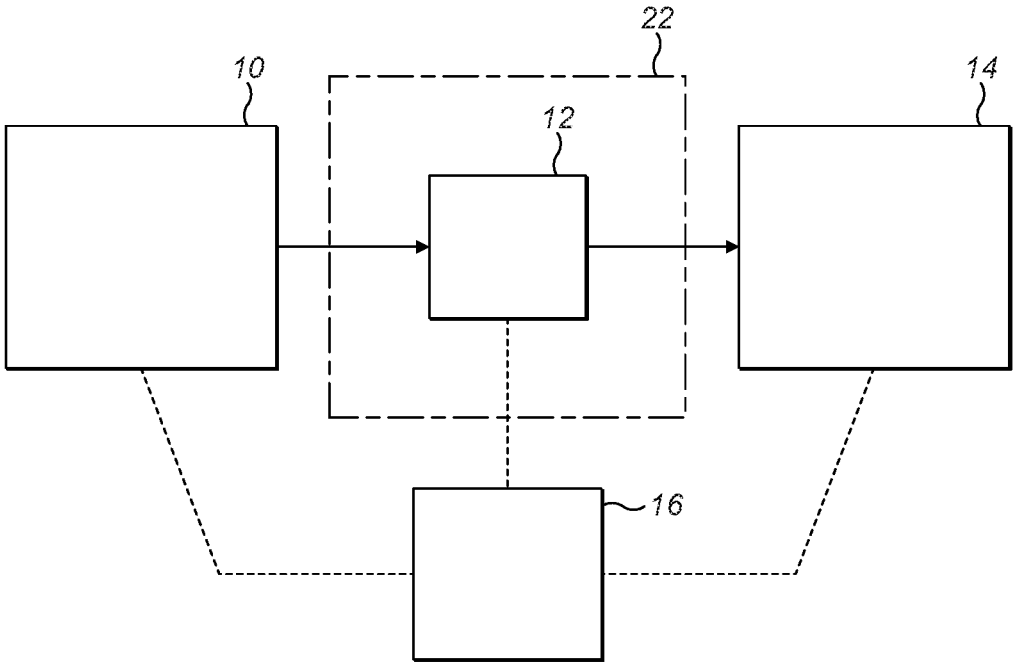
FIG. 1 is a schematic representation of an apparatus implementing a method for controlling the filling of an ion trap with a predetermined quantity of ions.

FIG. 1 shows schematically a portion of a mass spectrometer for performing the method of the invention. FIG. 1 also shows a controller which is an embodiment of the invention.

Specifically, FIG. 1 includes a source of ions 10. In this case, the source of ions is an electrospray or plasma ion source operating at atmospheric pressure and followed by atmosphere-to-vacuum interface and at least one RF ion guide, although other types of sources of ions such as an ion source or devices for storing ions could be used (such as an electron impact (EI) source or MALDI source at low or high pressure). FIG. 1 further includes an ion trap 14. In this example, the ion trap is a linear trap, although the described method is not limited to this type of ion trap. An ion path 18 extends between the source of ions 10 and the ion trap 14. Ions from the ion source 10 can pass along the ion path 18 and be received at the ion trap 14. Ions received at the ion trap 14 are at least temporarily stored or trapped therein. It will be appreciated that in the whole mass spectrometer, there may be one or more other ion optical devices provided, for example between the ion source 10 and the ion trap 14, such as ion guides, mass filters etc. as known in the art. The ion trap 14 may be a mass analysing ion trap or a mass analyser may be provided downstream of the ion trap 14 to receive ions from the ion trap.

An ion detector 12 is arranged on the ion path 18, between the source of ions 10 and the ion trap 14. The detector 12 can be used to detect (or 'sample') at least a portion of the ions transmitted along the ion path 18. Specifically, the detector 12 is used to detect at least some ions transmitted from the source of ions 10 during a plurality of distinct sampling time intervals. The detector 12 may be an image current detector, and thus does not collect or receive the sampled portion of ions. Alternatively, the detector 12 may be another type of ion detector, which requires collection of the sampled portion of ions in order for detection to take place. During a period of transmission of ions from the source of ions 10 (the "transmission time period"), the ions may either traverse through the detector 12 to reach the ion trap 14, or (in some cases, dependent on the type of detector) may instead be collected and detected at the detector 12.

A controller 16 is arranged to be in communication with the detector 12, and receive measurements therefrom. The controller 16 is configured to control the operation of the source of ions 10 and the ion trap 14 (either directly, or through additional ion optics not shown in FIG. 1).

As noted above, it is highly desirable to precisely control the filling of the ion trap. That is to say, it is desirable to control the quantity of ions stored within the ion trap at the end of a period of transmission of ions from the source of ions 10 and along the ion path 18 (the "transmission time period"). To accomplish control of the filling of the trap, the present invention 'samples' at the detector at least a portion of ions transmitted from the source of ions 10 along the ion path. The detector samples the ions during a plurality of distinct sampling time intervals interspersed within the transmission time period.

For instance, in the embodiment of FIG. 1, ions may be transmitted from the source of ions 10 and towards the ion trap 14 for a transmission time period. For the majority of this transmission time period, ions traverse the ion path 18 and are received at the ion trap 14. However, for at least two relatively short time intervals ("sampling time intervals") within the transmission time period, the detector 12 detects at least some ions transmitted from the ion source. In other words, the detector 12 intercepts ions traversing the ion path 18 during the sampling time intervals. Detection or 'sampling' of the ion current takes place only during the plurality of sampling time intervals.

The sampling time intervals are each much shorter than the transmission time period. In the specific example of FIG. 1, the transmission time period is 100 ms, whereas the sampling time intervals are each 10 μs. The sampling time intervals are interspersed throughout the transmission time period. In the example of FIG. 1, the sampling time intervals are interspersed equally. In other words, the time between each sampling time interval is equal. The time between each sampling time interval is sometimes denoted as an "accumulation interval" in the present specification, and can represent the time periods during which ions are accumulating at the ion trap 14. However, it should be noted that in some examples, only a portion of the ions traversing the ion path 18 during a sampling time interval are received at the detector 12. In this scenario, accumulation of ions may take place at the trap during both the sampling time intervals and the accumulation intervals. As such, accumulation of ions takes place at the trap 14 over the transmission time period as a whole.

In the present example, the accumulation intervals are 90 μs. Around 1000 sampling time intervals are interspersed during the transmission time period, having an accumulation time interval in between. As such, only a small proportion of the ions transmitted from the source of ions 10 are received at the detector 12, with the majority of the ions transmitted from the source of ions 10 being received at the ion trap 14. In the present example, the percentage of ions transmitted from the source of ions 10 and received at the ion detector 12 would be around 10%. However, the ion current sampled at the detector 12 provides an indication of any variation of the ion current during the transmission time period.

In practice, even a source of ions supplying a nominally constant ion current will demonstrate a variation in the magnitude of the ion current over time. The specific nature of the variation of the ion current will depend on a number of factors including the type of ion source, for instance. Nevertheless, the magnitude of the ion current varies in time over a particular timescale. The timescale can in some cases be considered a characteristic time for the variation, or an approximate period for the variation. As such, in the described method the time difference between the start of a sampling time interval and the start of an immediately subsequent sampling time interval (related to the frequency of the sampling time intervals within the transmission time period) is set to be less than the timescale for variation of the magnitude of the ion current. Setting the time difference in this way has the particular advantage that the frequency of sampling at the detector 12 is sufficiently fast to capture or detect the variation in the magnitude of the ion current.

Capturing the variation of the magnitude of the ion current by appropriately setting the time difference between the start of a sampling time interval and the start of an immediately subsequent sampling time interval to be less than the timescale of variation of the ion current, allows the present invention to more accurately monitor and predict the rate of filling at the ion trap 14. In particular, periods during which the filling rate at the ion trap 14 is increased (as a result of a higher ion current) can be taken into account. As such, the transmission time period over which a predetermined quantity of ions will be received at the ion trap 14 can be more accurately predicted.

Accordingly, the transmission time can be estimated and subsequently set as ions are detected at the detector 12 during the plurality of sampling time intervals. The transmission time period can be estimated by extrapolation of the measured rate of ions received at the detector 12, for instance. Alternative algorithms for defining the proportionality between the number of ions (or the ion current) detected at the detector 12 can be envisaged.

Thus, the estimation (or calculation) of the transmission time period is a dynamic process throughout the transmission time period. In the present example, a new estimation of the transmission time period is calculated at the end of each sampling time interval, based on the total ions received at the detector 12 during any preceding sampling time interval. The process of detection of ions at the detector 12 during each sampling time interval accordingly provides feedback to the system, in order to estimate and set the transmission time period in an iterative way.

In the present example, the ion detector 12 could include a grid in the way of ions on the ion path 18, in order to advantageously enable direct and uninterrupted detection of ions or secondary particles. In this case, the time difference between the start of each sampling time interval can be made very short if desired, being defined just by the acquisition rate of the detection electronics. Where ions are detected, an electrometer could be used, while in the case of detection of secondary particles either an electrometer or electron multiplier could be employed. Nevertheless, to avoid contamination and charging up from ion beams, the grid should be heated or periodically flushed with ozone or oxygen plasma.

In summary, the present inventors have recognised prior art methods of estimation of a filling time of the ion trap are inadequate when an ion current is highly unstable or has inherently transient character (e.g. pulsed from an ion trap or a pulsed ion source). Instead, they have identified that, to obtain an accurate estimate of the filling time of an ion trap, ideally a form of automatic gain control should take place concurrently with ion accumulation in the trap, and be representative of ion current at a particular instant. Moreover, the present inventors have realised that this objective can be achieved by intercepting a small portion of the incoming ion beam at suitable time intervals, which are substantially shorter than a characteristic time of variation of the ion current. In some typical examples, the time of variation of the current lies in the range of hundreds of microseconds. As such, the inventors have provided an improved, more precise method for controlling the filling of an ion trap with a predetermined quantity of ions.

Figure 2:
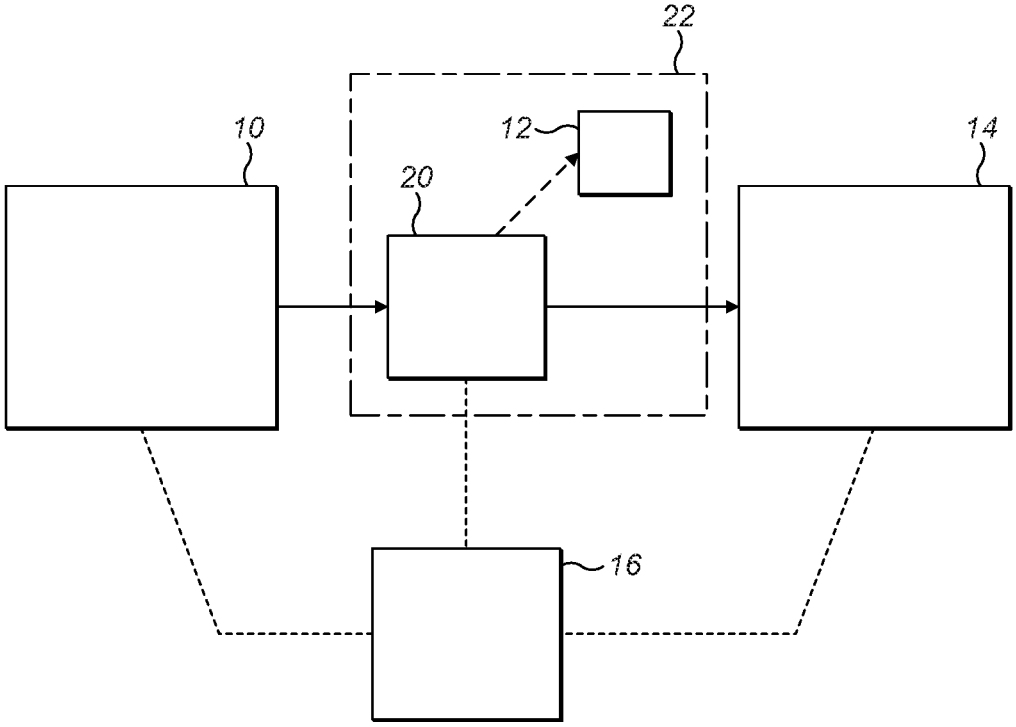
FIG. 2 is a schematic representation of an apparatus implementing a method for controlling the filling of an ion trap with a predetermined quantity of ions, according to a second example.

FIG. 2 shows an example having a number of features corresponding to the example of FIG. 1. In particular, the example of FIG. 2 shows a source of ions 10 and an ion trap 14. Ions from the source of ions 10 are transmitted along an ion path 18 and received by an ion trap 14. A detector 12 is capable of receiving ions transmitted from the ion source 10. However, in this example the detector 12 is an auxiliary detector, arranged external to the ion path.

FIG. 2 further includes ion optics 20 arranged on the ion path 18, between the source of ions 10 and the ion trap 14. The ion optics 20 are configured to controllably direct (i.e. deflect) ions towards the detector 12 and away from the ion path 18 (see dashed arrow in FIG. 2). For instance, in this example, the ion optics 20 comprise a beam switching apparatus which can direct the 'ion beam' either towards the external ion detector 12 or to the ion trap 14, dependent on the potentials applied to portions of the beam switching apparatus.

A controller 16 is arranged to be in communication with the detector 12 and the ion optics 20. The controller 16 is further arranged to control the operation of the source of ions 10 and the ion trap 14 (either directly, or through additional ion optics, not shown in FIG. 2).

In use, the example of FIG. 2 operates in a similar manner to that of FIG. 1. In particular, ions are transmitted from the source of ions 10 over a transmission time period. During the transmission time period, the majority of the ions are received at the ion trap 14, and are accumulated therein. However, at distinct sampling time intervals interspersed within the transmission time period, ions are received at the detector 12. In this example, the ion optics 20 deflect the ions towards the detector 12 during the sampling time intervals. Over the transmission time period but outside of the sampling time intervals, the ion optics 20 allow the ions to proceed along the ion path 18 to the ion trap 14. The controller 16 may control this process through the application of appropriate voltages at the ion optics 20 to deflect the ions towards the detector 12 during the sampling time intervals.

As in the example of FIG. 1, the ion current is varying in time. The frequency of the sampling time intervals is set to be sufficiently fast that the ions detected at the ion detector 12 reflect the variation in the ion current. In other words, the time difference between the start of a sampling time interval and the immediately subsequent sampling time interval is less than the timescale of the variation of the ion current.

In the specific example of FIG. 2, the sampling time intervals are equal, each being 20 μs. An accumulation time interval (between the end of a sampling time interval and the start of a subsequent sampling time interval) is 80 μs. Thus, the time difference between the start of a sampling time interval and the start of the immediately subsequent sampling time interval is 100 μs. This is much less than the characteristic timescale of variation of the ion current, which in this specific example would be 200-500 μs for the RF ion guide of length L and the gas pressure P, wherein $P \times L > 0.2$ mbar mm. The overall transmission time period is 100 ms, with the total of the plurality of sampling time intervals making up 20% of the overall transmission time period. 1000 sampling time intervals are interspersed within the transmission time period.

In the example of FIG. 2, a well-shielded Faraday cup is used as the detector 12. The Faraday cup is connected to a differential-input electrometer (not shown in FIG. 2) with a detection limit of 10,000-100,000 elementary charges. In most cases, 5 to 20% of the ions transmitted from the source of ions 10 during the transmission time period would be received at the Faraday cup by suitable selection of the sampling time interval. Therefore this design is especially suitable for filling ion traps with ion numbers in the range of $10^5$-$10^6$ ions, such as required for the Orbitrap™ mass analyser. Nevertheless, if an electron multiplier of any type is used in place of the Faraday cup, then lower numbers of ions could be detected and a shorter sampling time interval (e.g. totalling 1-5% of the total transmission time period) could be used.

Figure 3:
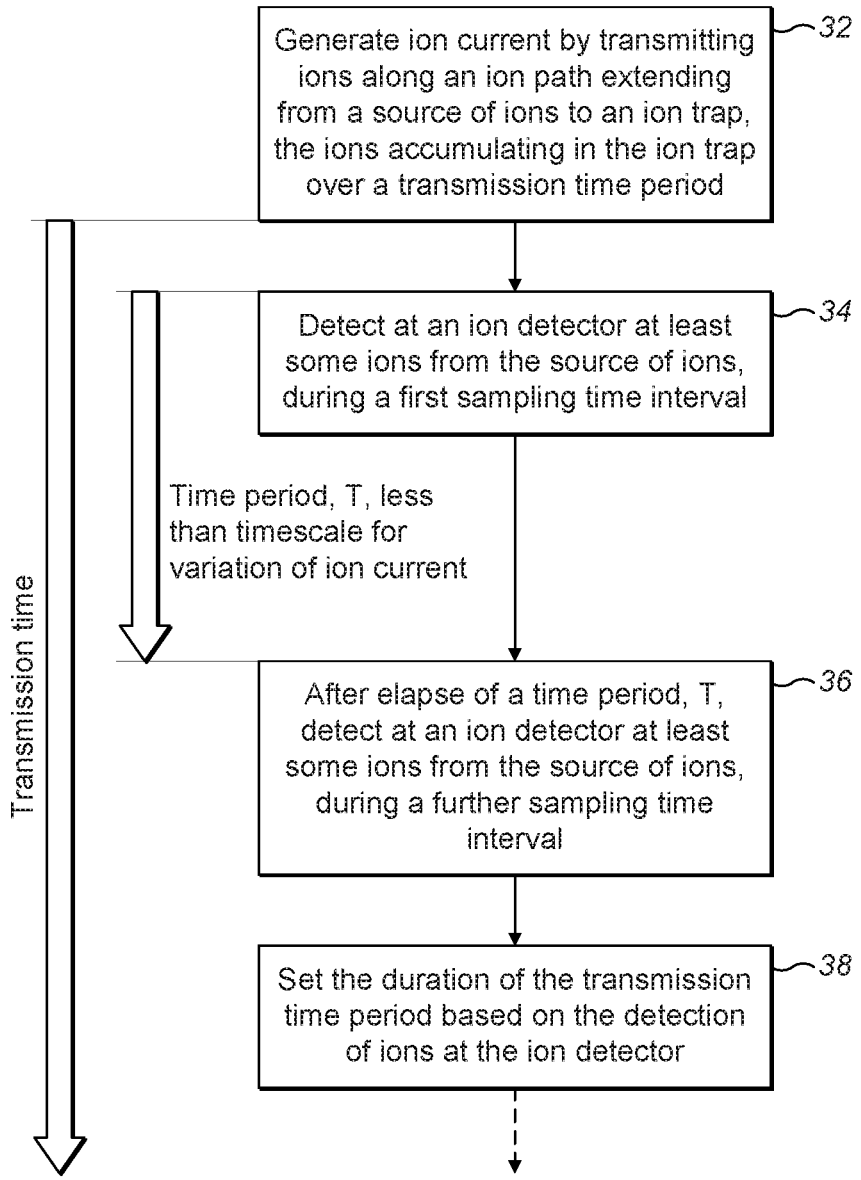
FIG. 3 is a flow diagram illustrating a method for controlling the filling of an ion trap with a predetermined quantity of ions.

FIG. 3 illustrates a method of controlling the filling of an ion trap with a predetermined quantity of ions. The method begins with the generation of an ion current by transmission of ions from a source of ions along an ion path (step 32). The path extends from the source of ions to an ion trap. Ions that traverse the ion path are received at the ion trap, and accumulate over a transmission time period (i.e. the time period over which ions can traverse the ion path). The magnitude of the ion current varies with time.

In a second step (step 34), at least some ions from the ion source are detected at a detector. The ions are detected at the detector during a first, distinct sampling time interval.

In a third step (step 36), ions from the ion source are received at the detector during at least one further distinct sampling time interval. The time difference, T, between the start of the further sampling time interval and the immediately preceding time interval is less than a timescale of variation of the magnitude of the ion current generated by the source of ions.

In a fourth step (step 38), the duration of the transmission time period is set based on the detection of ions at the ion detector. For instance, this could be estimated from a fill rate determined from the ions detected during the first and any further sampling time intervals at the detector, or based on a comparison of the number of detected ions to a predetermined value.

Figure 4:
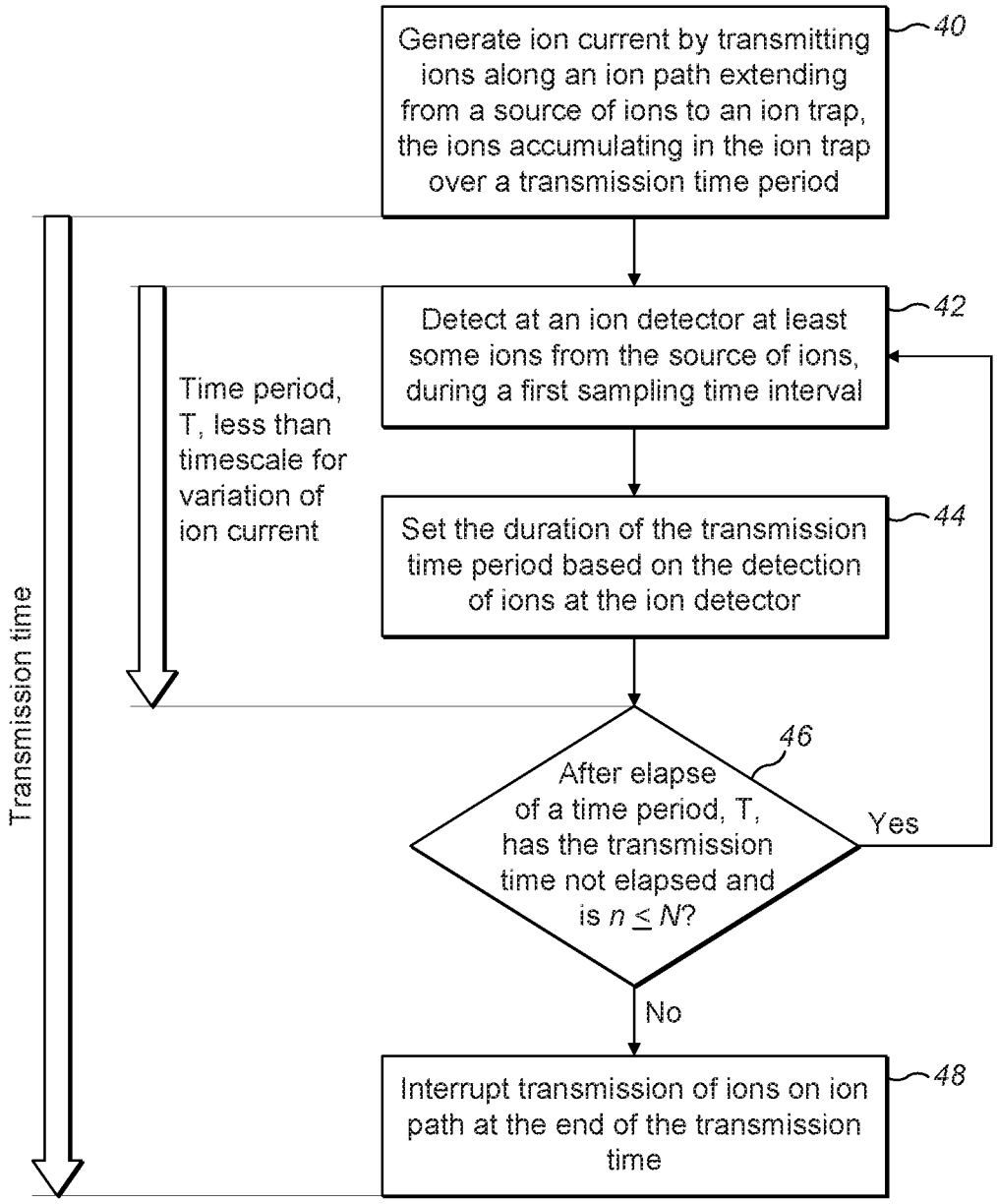
FIG. 4 is a flow diagram illustrating a method for controlling the filling of an ion trap with a predetermined quantity of ions, according to a second example.

FIG. 4 illustrates a further example of the method of controlling the filling of an ion trap with a predetermined quantity of ions. Again, the method begins by generating an ion current by transmission of ions from a source of ions along an ion path (step 40). The path extends from the source of ions to an ion trap. Ions traverse the ion path over a transmission time period and can be received at the ion trap. The magnitude of the ion current varies with time.

During a first sampling time interval within the transmission time period, at least some ions from the source of ions are detected at a detector (step 42). Subsequently, the duration of the transmission time period can be set (step 44). In particular, the transmission time period can be set based on the number of ions received at the detector during the sampling time interval. For instance the quantity of ions detected by the detector during the first time interval can be used to determine a filling rate for the ion trap, and so an estimate of the time for a predetermined quantity (or population) of ions to accumulate in the ion trap. Alternatively, the transmission time period can be terminated once the total number of ions received at the ion detector exceeds a predetermined amount. This disclosure is not limited to these methods of setting the transmission time, however. Other algorithms to estimate and set a transmission time based on the total quantity of detected ions received at the ion detector during the plurality of sampling time intervals would be apparent to the skilled person.

The steps of detecting the ions at the ion detector can be repeated for a plurality of further sampling time intervals interspersed within the transmission time period (step 46). In particular, the step of detecting the ions at the ion detector and the subsequent step of setting the transmission time period based on the total quantity of detected ions received at the ion detector can be repeated N times within the transmission time. This will yield N+1 samplings of the ion current at the ion detector. It is noted that the value of N will depend on the transmission time set, and the time difference between the start of a sampling time interval and the subsequent sampling time period. The start of each sampling time interval is separated by a time difference, T, from the start of the immediate preceding sampling time interval. After elapse of each sampling time interval, the transmission time period can be set, as described above.

In other words, the method comprises receiving at an ion detector at least some ions from the source of ions during an $n^{th}$ distinct sampling time interval, where $2 \leq n \leq N+1$ and $n \in \mathbb{N}$. The start of the $n^{th}$ distinct sampling time interval is spaced from the start of the immediately preceding (i.e. $n-1^{th}$) distinct time interval by a time difference, which is less than the timescale of variation of the ion current. After elapse of the $n^{th}$ sampling time interval, the duration of the transmission time period can be set based on the total quantity of ions received at the ion detector during the $n^{th}$ and each preceding sampling time interval. In this way, the transmission time is set in an iterative process.

After elapse of the transmission time period, the transmission of ions along the ion path is interrupted (step 48). For instance, this could be by shut down or modulation of the ion source, or otherwise blocking or preventing the ions from entry to the ion trap.

FIGS. 5A to 5G demonstrate measures of the timescale of variation of the ion current. It will be understood that the timescale of variation represents the average period over which the ion current changes significantly. For instance, it could be considered a characteristic time, which is an estimate of the order of magnitude of the time over which a change in the ion current occurs. The nature of the timescale of variation of the ion current will vary dependent on the particular ion source type, as well as any modulation of the ions whilst traversing the ion path. Rate of variation is typically dampened down by gas-filled radiofrequency (RF) ion guides as widely used in the art. A particular measure of the timescale of variation of the ion current can be selected based on its suitability in view of these parameters.

In a first instance, the ion current may be varying approximately periodically. For instance, the ion current may increase and decrease periodically if the source of ions is a pulsed ion source (such as a laser or MALDI source). In this respect, the time period for variation of the ion current will be the average period of the ion current. This type of variation in the ion current is shown in FIG. 5A, with average period, or timescale of variation of the ion current, $\tau$.

Figure 5A:
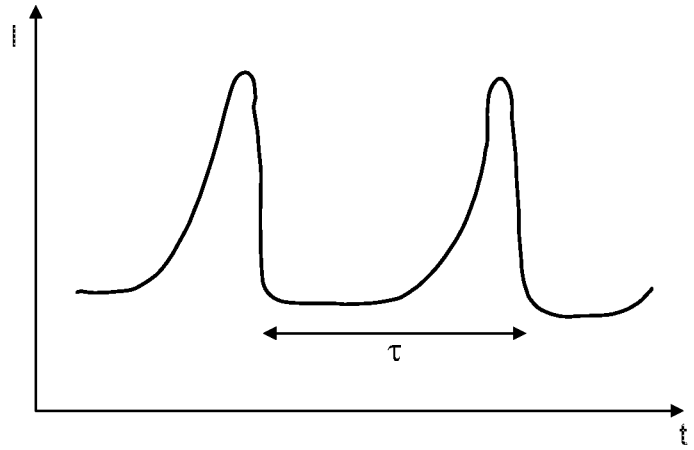
FIG. 5A is a schematic representation of an ion current which varies in time, and a first measure of a timescale of variation of the ion current.

It should be noted that where the ion current is represented by periodic, distinct pulses (as illustrated in FIG. 5A) the timescale of variation can be considered the average pulse period, for instance. However, the time difference between the start of a sampling time interval and the immediately subsequent sampling time interval should then be chosen as not only less than this timescale of variation, but preferably much less (and ideally less than the width of the pulse). More preferably, the time difference between the start of a sampling time interval and the immediately subsequent sampling time interval should be much less than the rise- or fall-time of the pulse peak.

Figure 5B:
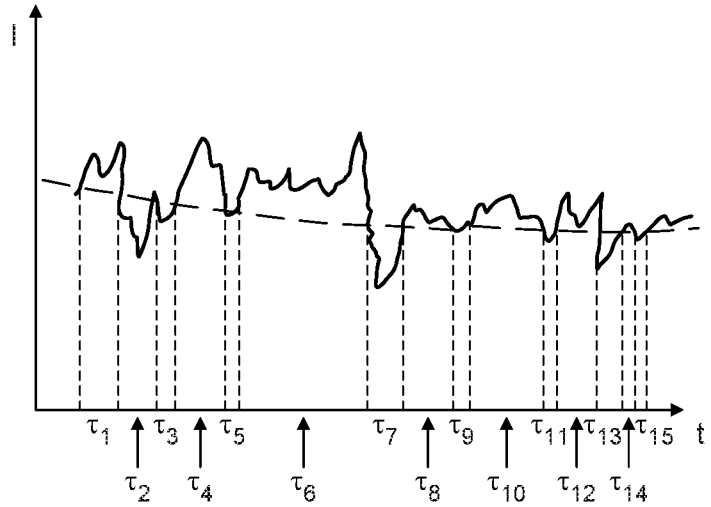
FIG. 5B is a schematic representation of an ion current which varies in time, and a second measure of a timescale of variation of the ion current.

In an alternative scenario, the ion current may be approximately constant. However, even the most stable ion sources have been shown to suffer from beam instability as well as noise up to many kHz. This instability can affect the ion filing rate at the ion trap, and thus in prior art methods risks overfilling the ion trap resulting in space-charge effects. Using prior art methods, a conservative filling time may be chosen to avoid space-charge effects, but this can result in a lower number of ions available for mass analysis.

Where the ion current is approximately constant in this way, a timescale for variation of the ion current can be calculated as the average time difference between instances of the ion current being equal to the moving average magnitude of the ion current. For example, FIG. 5B illustrates a noisy and unstable ion current, with the moving average magnitude of the ion current shown as a dotted line. A time difference or period can be calculated between each instance of the ion current crossing the moving average. Each said time period is marked as $\tau_{1, 2, 3, 4}, \ldots$ in FIG. 5B. The timescale of variation can then be calculated as the average of all $\tau$. In some circumstances, the median or the mean average may be appropriate. This measure of the timescale for variation of the ion current may also be used to determine the timescale for variation of the ion current for ion current which may or may not be approximately constant, and which exhibits step-wise changes, which exhibits periodic oscillations, or which exhibits aperiodic oscillations.

Where the timescale for variation of the ion current is determined as the average time difference between instances of the ion current being equal to the moving average magnitude of the ion current, an appropriate base or window for the moving average must be selected. An appropriate selection of the time base may depend upon the ion source, and the ion optics and analyser used. In particular, the base for the moving average must be shorter than: (a) the average duration of ion accumulation prior to a scan, and/or (b) the duration of the scan (the transmission time period), and/or (c) the duration over which any voltages on the ion optics are kept constant. Nevertheless, the base for the moving average needs to be longer than (and preferably much longer than): (a) the temporal broadening during collisional cooling, and/or (b) the minimum gating time of the ion optics (or split or dual gate) arranged for injection of ions into trapped ion analysers (for instance linear ion traps or Orbitrap™ analysers), and/or (c) the average settling time of voltages on the ion optics (in other words, the shortest time of ion optics change). Moreover, the time base for the averaging should be longer (and preferably much longer) than the duration of a single sampling time interval, t (90 in FIG. 8).

Figure 5C:
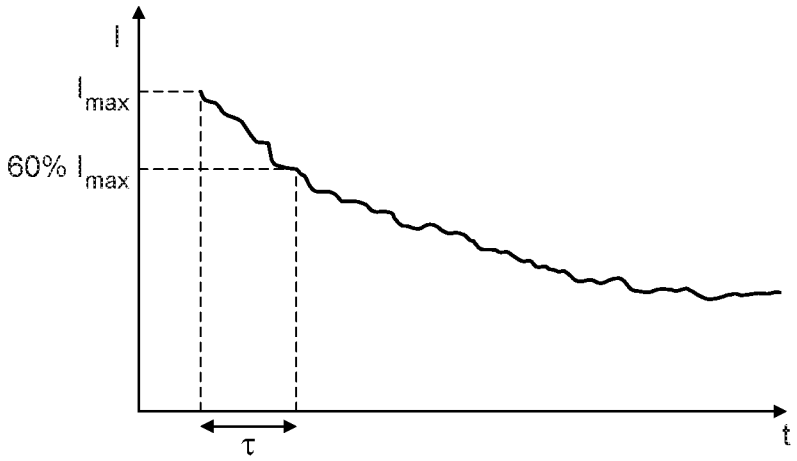
FIG. 5C is a schematic representation of an ion current which varies in time, and a third measure of a timescale of variation of the ion current.

FIG. 5C shows an alternative behaviour for the variation of the ion current in time. In this example, the ion current reduces in time from a maximum ion current, $I_{max}$. Here, the timescale for variation of the ion current can be defined as the time taken for the ion current to reduce by a predefined percentage of the maximum. In the particular example, of FIG. 5C, the timescale for variation of the ion current, $\tau$, is set as the time in which the ion current reduces to 60% of the maximum ion current, $I_{max}$.

Figure 5D:
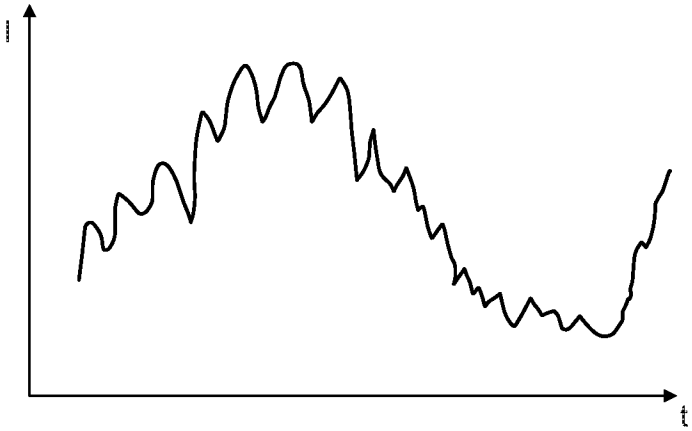
FIG. 5D and FIG. 5E is a schematic representation of an ion current which varies in time, and a fourth measure of a timescale of variation of the ion current.
Figure 5E:
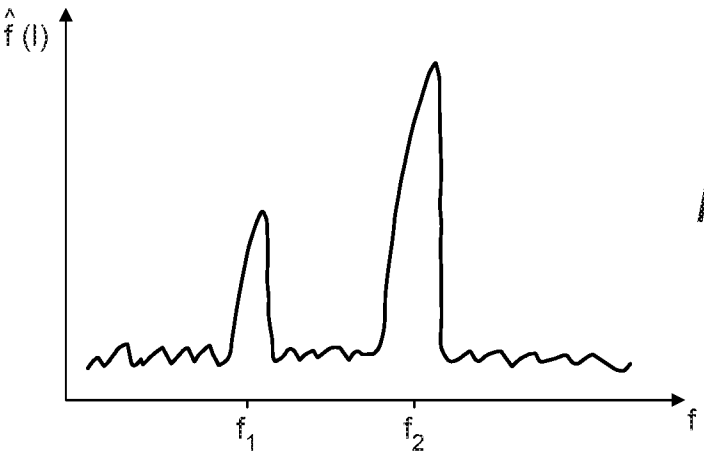

FIG. 5D and FIG. 5E show a still further method of characterising the timescale of variation of the ion current. In this example, the ion current exhibits fluctuations due to noise consisting of multiple frequencies. Thus, the ion current is the sum of all signals, including multiple periodic noise signals (see FIG. 5D). To accurately estimate an appropriate filling time for the ion trap, the sampling frequency should be less than the fastest significant frequency within the noise spectrum. In this way, the sampling will resolve the variations in the ion current due to noise.

In view of this, the timescale for variation of the magnitude of the ion current can be determined based on a Fourier transform of the ion current to the frequency domain. In particular, the timescale for variation of the ion current can be considered as the reciprocal of the frequency of a peak in a Fourier transform of the ion current, said peak being the highest frequency peak that exceeds a certain amplitude threshold. Looking to the present example, FIG. 5E shows the Fourier transform of the ion current in FIG. 5D to the frequency domain. Two significant peaks can be seen in the Fourier transform, as $f_1$ and $f_2$. Frequency $f_2$ is higher than frequency $f_1$. Here, the timescale of variation of the ion current can be defined as $1/f_2$.

Figure 5F:
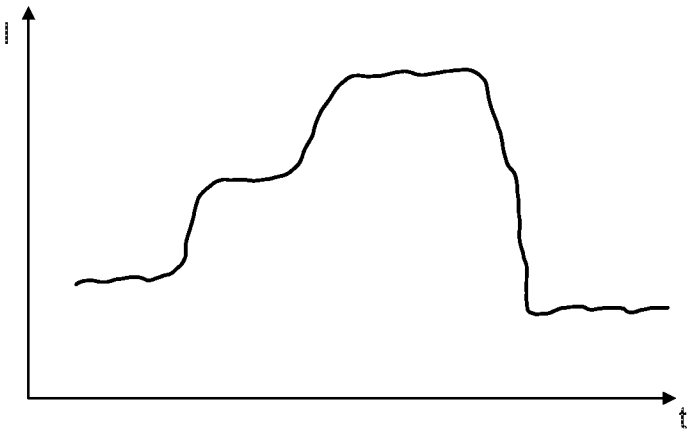
FIG. 5F and FIG. 5G is a schematic representation of an ion current which varies in time, and a fifth measure of a timescale of variation of the ion current.

A further measure of the timescale for variation of the ion current can be considered where the ion current varies approximately stepwise. An example ion current is shown in FIG. 5F. It can be seen that the steps in the ion current are broadened or slightly smoothed compared to an ideal stepwise current. This may be a result of diffusion broadening, for instance due to use of a gas-filled RF ion guide along the ion path.

Figure 5G:
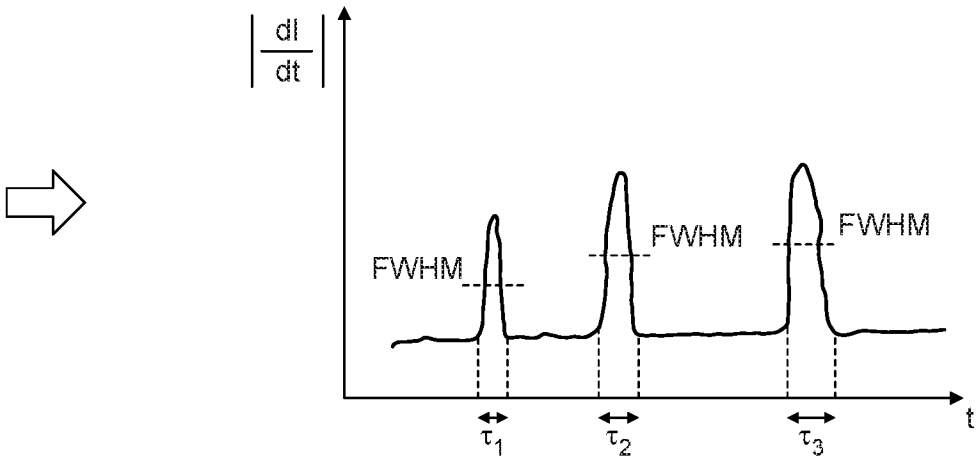

FIG. 5G shows the derivative of the ion current with time. The derivative of an ideal stepwise function results in Dirac delta functions at the times representing the vertical portion of each step. However, due to the broadening in the real, approximately stepwise ion current, peaks can be seen at the time of each step in the ion current. The width of the peaks represent a timescale for the broadening of the stepwise ion current, and so a suitable timescale for variation of the ion current. For example, the mean average of the peak width at the full-width, half-maxima of each peak in the absolute value of the derivative can be used as the most general timescale for variation of the ion current. In relation to FIG. 5G, this would be the average of each of $\tau_1$, $\tau_2$ and $\tau_3$.

In a still further example, the timescale for variation of the ion current may be characterised by considering the autocorrelation of the ion current. As will be understood by the skilled person, autocorrelation describes the similarity (or correlation) between two instances in a signal as a function of the time lag or delay between them. In particular, the timescale of variation of the ion current may be considered as the mean average time lag between two observations of the ion current having an autocorrelation value of more than a predetermined value. For example, the average time lag between two observations having an autocorrelation value of more than 0.5.

In some cases, an appropriate timescale of variation of the ion current may be known without investigation. For instance, this may be the case when a pulsed ion source is used, where the approximate period of the pulsed ion current would be apparent. However, in other scenarios, the timescale of variation may not be known prior to filling the ion trap. In this case, a pre-measurement of the ion current can be performed to determine the timescale of the variation in the ion current. For instance, the ion current may be measured continuously at an ion detector for a predefined period of time. The measured ion current in this period can then be analysed to determine the timescale for variation, according to one of the measures detailed above.

Considering once again the examples of FIG. 1 and FIG. 2, the apparatus may be arranged to interrupt the ion current after elapse of the transmission time. For instance, the source of ions may be switched off or modulated, or the ions on the ion path may be blocked from entering the ion trap. This may require additional ion optics, not shown in FIGS. 1 and 2.

Figure 6:
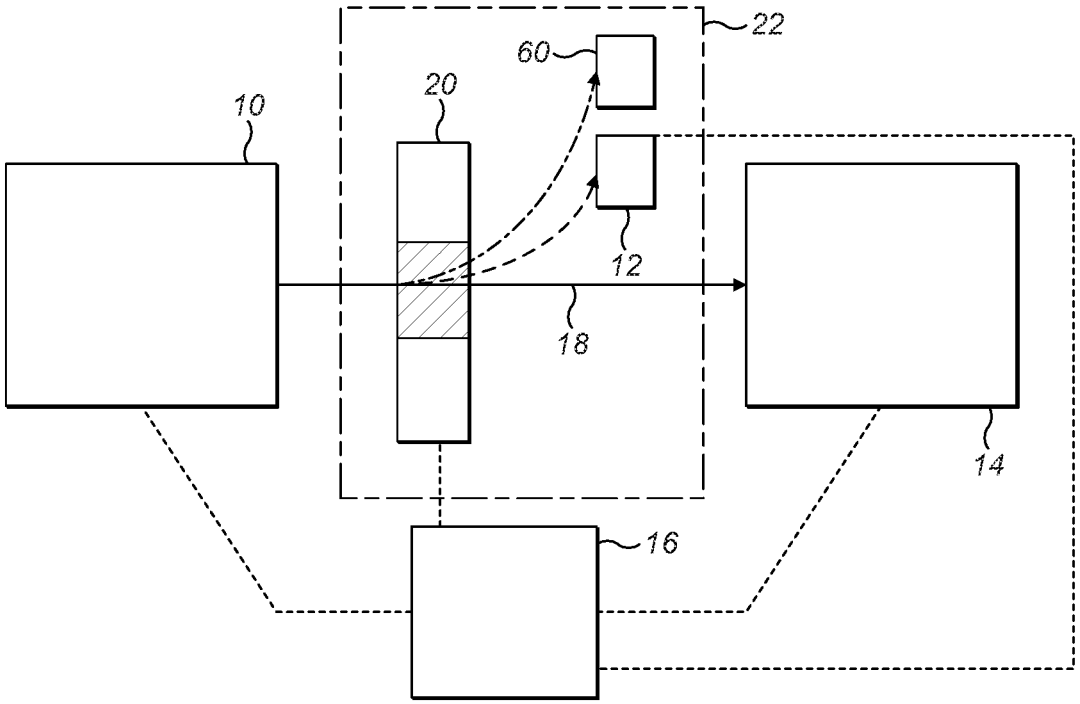
FIG. 6 is a schematic representation of an apparatus implementing a method for controlling the filling of an ion trap with a predetermined quantity of ions, according to a third example.

FIG. 6 demonstrates a specific example in which the transmission of ions along the ion path 18 is interrupted by deflection of the ions from the ion path 18 to an ion dump 60. In this case, the ion optics 20 shown in FIG. 2 for intermittently directing ions to the detector 12 can also be used to direct (or deflect) ions to the ion dump 60.

FIG. 6 shows a source of ions 10, which in use supplies ions along an ion path 18 towards an ion trap 14. Ion optics 20 are arranged on the ion path 18 between the source of ions 10 and the ion detector 12, such that at least a portion of ions can be deflected away from the ion path 18. In particular, the ion optics 20 can direct ions to either an auxiliary detector 12 (see dashed arrow in FIG. 6) or towards an ion dump 60 (see dashed-dot arrow in FIG. 6), dependent on the voltages applied at the ion optics 20. In particular, the ion optics 20 may comprise an ion gate, wherein applying a first voltage (or a zero voltage) causes the ions pass along the ion path 18 to the ion trap 14. Applying a second voltage to the ion gate causes the ions to be deflected off the ion path 18 towards the ion detector 12, as required during each sampling time interval. Applying a third voltage to the ion gate causes the ions to experience a different deflection (generally, a greater deflection) than compared to the period when the second voltage is applied, so as to instead move the ions towards the ion dump 14. Application of a third voltage in this way can be used to terminate the transmission of ions along the ion path 18, after elapse of the time transmission period.

Figure 7:
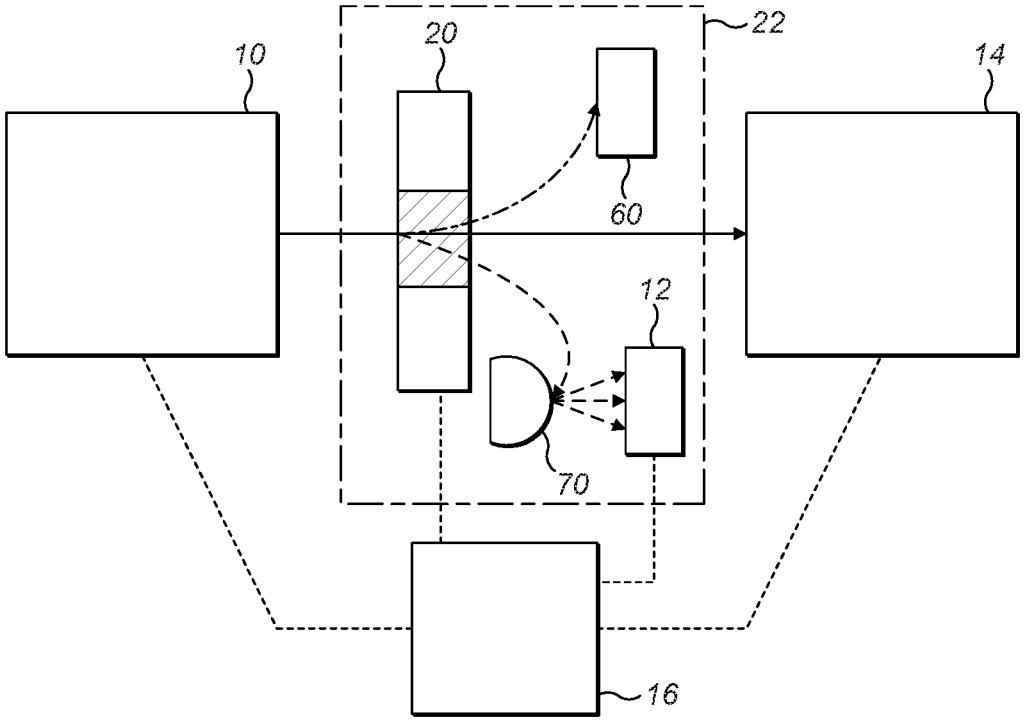
FIG. 7 is a schematic representation of an apparatus implementing a method for controlling the filling of an ion trap with a predetermined quantity of ions, according to a fourth example.

A further example in which the ion detector 12 is an electron multiplier is shown in FIG. 7. Here the ion detector 12 is a highly sensitive single-ion detector. Specifically, FIG. 7 shows a source of ions 10, from which ions are transmitted along an ion path 18, towards an ion trap 14. On the ion path 18 between the ion source 10 and the ion trap 14 is arranged an ion gate 20. An ion dump 60 is arranged to the side of the ion path 18, and a dynode 70 and detector of secondary particles 12 is arranged off the ion path 18, approximately opposite the ion dump 60. To avoid premature aging of the ion detector, ions that are dumped at the end of the transmission time period are deflected by the ion gate 20 to an ion dump in a direction approximately opposite to the detector.

In use, with appropriate selection of applied voltages to the ion gate 20 the ions transmitted from the ion source 10 along the ion path 18 can be directed from the ion path 18 to either the ion trap 14, the detector 12 or the ion dump 60. For instance, the ions move along the ion path 18 when a first voltage is applied to the ion gate 20 (see solid arrow in FIG. 7). The first voltage is applied during the 'accumulation intervals', over which ions are accumulated at the ion trap 14.

Upon application of a second voltage to the ion gate 20, the ions are deflected from the ion path 18 and in the direction of the dynode 70 (see dashed arrow in FIG. 7). Secondary particles generated by receipt of the ions at the dynode 70 can be directed to the detector of secondary particles or electron multiplier 12. The second voltage is applied during the sampling time intervals, in order to result in ions being received at the detector 12 during these intervals. In this way the detector of secondary particles 12 is used to 'sample' the ion current along the ion path 18. The frequency of the sampling time intervals (in other words, the time difference between the start of the application of the second voltage during a first sampling time interval and the start of the application of the second voltage in the immediately subsequent sampling time interval) is less than the timescale for variance of the magnitude of the ion current.

Finally, after elapse of the transmission time period, a third voltage is applied to the ion gate 20, causing deflection of ions towards the ion dump 60 (see dot-dashed arrow in FIG. 7).

In the examples of FIG. 6 and FIG. 7, it is particularly important that ions moving along the ion path do not experience deflection unless the ion gate 20 is activated. This can be achieved by applying an appropriate voltage to an electrode at the ion dump, in order to compensate for sag in the electrostatic field from the detector 12 and/or from the dynode 70. Alternatively a shielding grid could be used (not shown in FIG. 6 or FIG. 7).

For inorganic ions, direct detection by a secondary electron multiplier (SEM) is possible and ion energies of 1-2 keV are sufficient for efficient detection. Any type of SEM could be used, for instance a channeltron, microchannel plates, a dynode, a dynode with scintillator and photomultiplier (PMT) or with a solid-state photomultiplier/avalanche diode, or even a combination thereof.

For organic (and especially protein) ions, a separate conversion dynode is necessary. In this case voltage on the dynode typically exceeds 10 kV at a polarity opposite to the ion polarity (e.g. −10 kV for positive ions, +10 kV for negative ions). Once ions for detection are sufficiently diverted from their stable path, they are captured by the attracting field of the dynode and impinge on it, thereby producing secondary particles (specifically, ions and electrons). These secondary particles are then drawn towards the secondary particle detector by the attractive field of the detector, as would be understood by a person skilled in the art. In the detector they impinge on a conversion dynode, are converted into electrons and then multiplied using a secondary electron multiplier, in order to provide an indication of the ion current.

Figure 8:
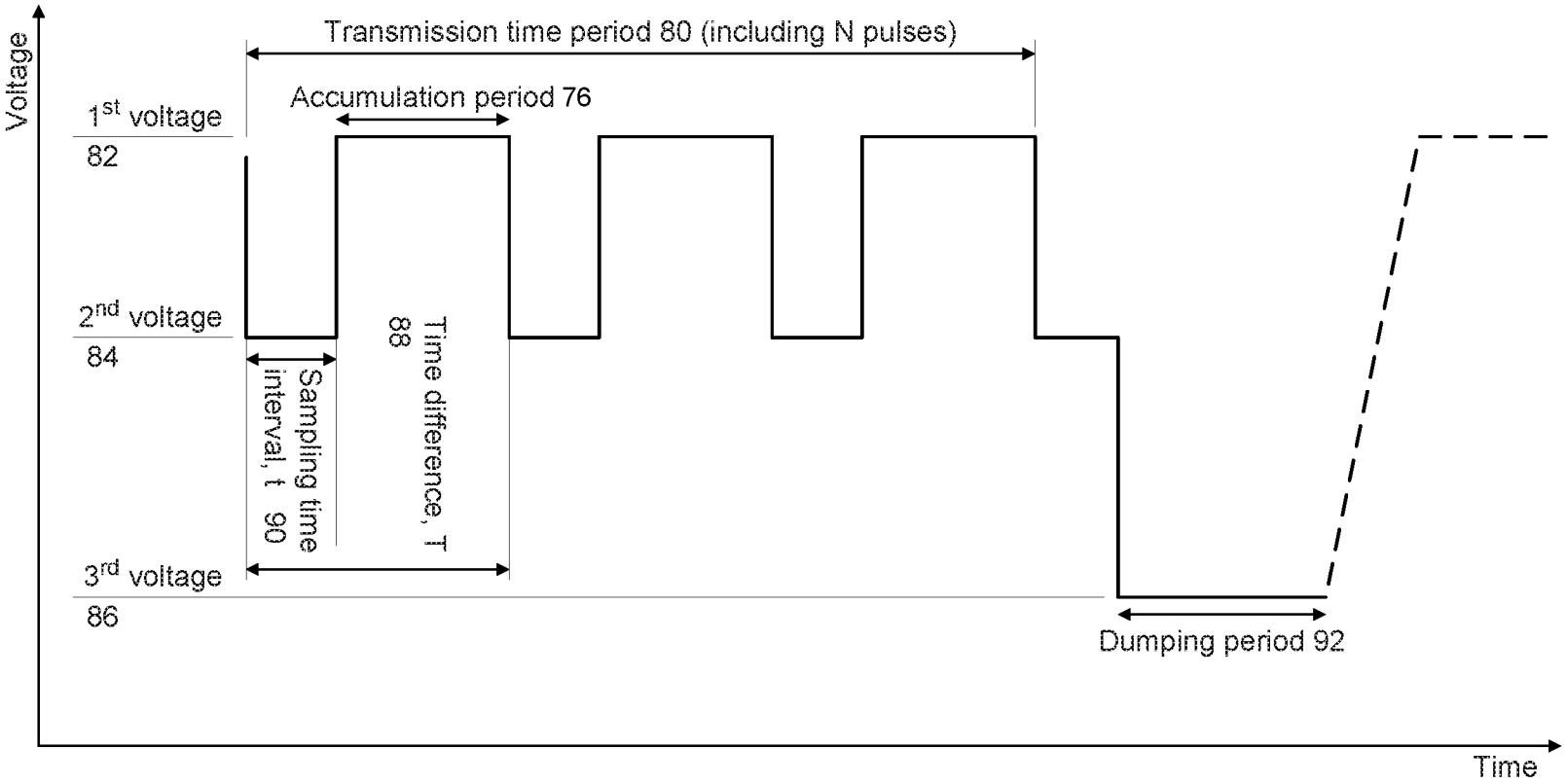
FIG. 8 is a plot illustrating the voltages applied to ion optics during operation of the example of FIG. 6.

FIG. 8 shows an example of the voltages that can be applied to the ion optics 20 (or ion gate) in FIG. 6. In particular, ions are transmitted along the ion path 18 to the ion trap 14 when a first constant voltage 82 (which may be zero, or close to zero) is applied at the ion gate 20. During these periods, in which a first voltage 82 is applied at the ion gate 20, the ions may be accumulated within the ion trap 14. In some circumstances, these periods can be denoted 'accumulation intervals' 76.

According to the present example, a second voltage 84 can be applied at the ion gate 20 intermittently, for the period of a sampling time interval, t 90. The second voltage 84 is greater in magnitude (for instance, more negative) than the first voltage 82, and is approximately constant. During the sampling time interval, t (in other words, during the time when the second voltage 84 is applied to the ion gate 20), the ions from the ion source 10 are deflected from the ion path 18 and directed towards the ion detector 12.

The second voltage 84 is applied on a plurality of occasions within the transmission time 80. In other words, the ion gate 20 is pulsed, with a square wave voltage pulse oscillating between the first voltage 82 and the second voltage 84. The period of the pulse is the time difference, T, 88 between the start of a sampling time interval and the immediately subsequent sampling time interval. The time difference, T, 88 could also be considered as associated with the sampling period, and consequently the sampling frequency. Accordingly, the time difference, T, is also the sum of a sampling time interval, t, 90 and an accumulation interval 76. A number, N, of pulses with period, T, can be applied within the transmission time period 80 (note that only three pulses are shown in FIG. 8, for clarity). The time difference, T, is less than (and preferably much less than) the timescale of variation of the magnitude of the ion current, τ, as described above with reference to FIGS. 5A to 5G.

At the end of the transmission time period 80, a third voltage 86 can be applied at the ion gate 20. The third voltage 86 is greater in magnitude (for example, more negative) than the second voltage 84, and causes the ions to be deflected further from the ion path 18 than compared to the transit of ions during the sampling time intervals, t (under the second voltage 84). Instead, during a period 92 when the third voltage 86 is applied, the ions are directed towards the ion dump 60. Thus, these ions are not accumulated at the ion trap 14, nor received at the ion detector 12. In this way, application of the third voltage 86 terminates the transmission of the ions along the ion path 18.

In the particular example of FIG. 6, the first voltage 82 applied at the ion gate is −50V, the second voltage 84 is −150V and the third voltage 86 is −350V. The first voltage 82 is applied for a period of 90 μs, between periods of application of the second voltage 84 for 10 μs. Accordingly, together this represents a high-frequency pulse having a period 88 of 100 μs (or frequency of 10 kHz). This period for the sampling of the ion current (in other words, the time difference between the start of a sampling time interval and the start of the immediately subsequent sampling time interval 88) is selected to be less than the time scale of variance of the ion current.

The transmission time period 80 is 100 ms, such that 1000 pulses (for instance, 1000 cycles of the application of the first and second voltages) are applied within the transmission time period 80.

Considering FIG. 8, it can be seen that the periods of application of the second voltage, interspersed between periods of the first voltage, represent a high frequency square wave voltage pulse applied at the ion gate. In other words, the gate is pulsed at high frequency. Where ion guides are arranged nearby to the pulsed ion gate (as would be customary when the examples of FIG. 2, FIG. 6 or FIG. 7 are incorporated into various mass spectrometer configurations) the high frequency pulse applied at the ion gate can result in perturbation at the ion guide and subsequent noise on the ion current. For reduction of this noise, a measurement of the offset to the ion current is introduced. The offset to the ion current created by the background noise within the system can be subtracted from each signal at the ion detector. As a result, currents in the femtoampere range and total charges in the femtocoulomb range can be detected at the ion detector.

Figure 9:
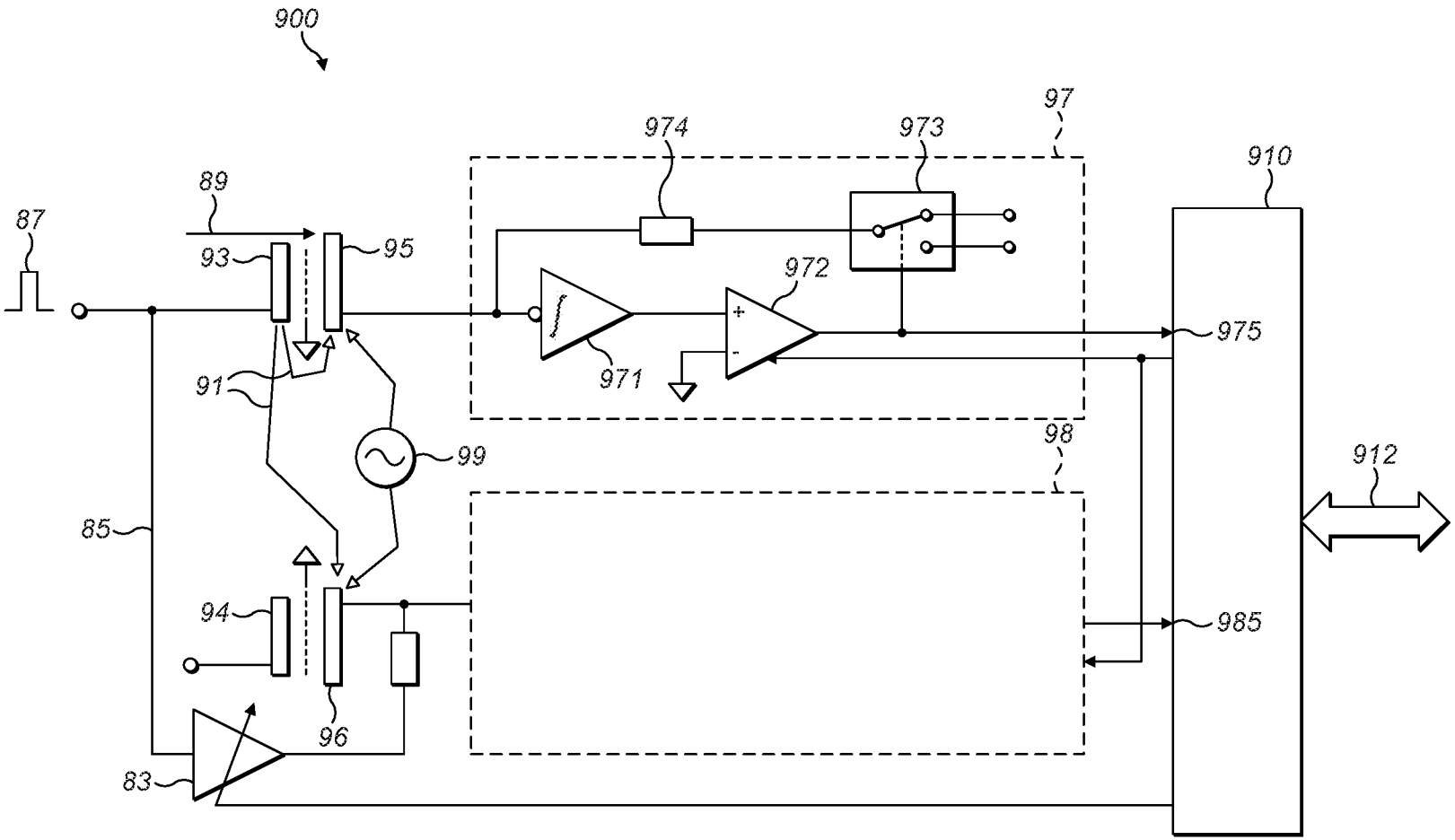
FIG. 9 illustrates electrical circuitry employed together with the described examples.

An example of the electronic circuitry used to first determine the offset to the ion current due to noise, and then subtract this offset from a measured ion signal, is shown in FIG. 9. This circuitry may be especially useful when used together with the examples of direct current measurement of FIG. 2, FIG. 6 and FIG. 7. Nevertheless, such circuitry may also advantageously be applied to prior art systems for automatic gain control (where there is a pre-measurement of the ion current performed prior to acquisition of ions by a mass analyser).

As such, FIG. 9 shows a simplified diagram of an electrometer 900 for use in measuring the ion current of the deflected ion beam. The ion optics, as described above with reference to FIGS. 2, 6 and 7, are used to deflect the ion beam 89 prior to measurement. In FIG. 9, the ion optics include a deflector electrode 93 and a lens electrode 94. In parallel to the deflector 93 and lens 94 electrodes, there are first and second detection electrodes, Det+ 95 and Det− 96, respectively. In use, a deflector control signal 87 is applied to the deflector electrode 93, thereby causing the ion beam 89 to be deflected towards the first detection electrode Det+ 95. The charge subsequently received at the first detection electrode Det+ 95 is then measured using a charge-to-digital converter 97. As discussed above, the ion beam is intermittently deflected (being deflected only during the sampling time intervals 90) and so the deflector control signal 87 is effectively a pulsed signal, as shown in FIG. 8.

The electrometer 900 has a symmetrical structure, wherein the second detection electrode Det− 96 is associated with a corresponding charge-to-digital converter 98. This symmetrical structure allows elimination of symmetrical pickup noise, for example from power source 99 connected to the detection electrodes 95, 96. Such a power source (which may generate a signal affected by high frequency noise, for example) would induce equal charge as a result of noise on both the first and second detection electrodes 95, 96.

Despite partial electrostatic shielding between the deflector 93 and the first and second detection electrodes, Det+ 95 and Det− 96 respectively, a voltage pulse applied to the deflector 93 during the sampling time interval 90 can induce some charge on the detecting electrodes 95, 96 as a result of crosstalk 91. As a result, the induced charge as a result of crosstalk may distort the useful measured signal.

The magnitude of the induced charge as a result of crosstalk is lower on the second detection electrode Det− 96 (as a result of its greater distance to the deflector electrode 93 compared to first detection electrode Det+ 95). Therefore, for achieving full compensation of the crosstalk effect, a portion 85 of the deflector control signal 87 is applied to the second detection electrode Det− 96 through a controlled attenuator 83.

The electrometer 900 contains identical first and second charge-to-digital converters 97, 98, each consisting of an integrator 971, a comparator 972, a reference voltage switch 973 and an impedance means 974, through which a compensating charge is fed to the input of the integrator 971. As will be understood by the skilled person, although only the first charge-to-digital convertor 97 shows these components in FIG. 9, corresponding components are implemented in the second charge-to-digital convertor 98.

The digital signal output 975 from first charge-to-digital converter 97 is subtracted from the digital signal output 985 of second charge-to-digital converter 98 in the logical control block 910. As such, noise on the detection signal measured at first detection electrode Det+ 95, where it has been induced symmetrically on both the first and second detection electrodes, Det+ 95 and Det− 96 respectively, may be cancelled. Subsequently, the output digital signal, representative of the noise cancelled detected ion current, is transmitted from the control block 910 to a processor (not shown) via the control bus 912.

The above described examples (for instance, at FIG. 1, FIG. 2, FIG. 6 or FIG. 7) can be located in high vacuum ($<1e^{-3}$ mbar) area of a mass spectrometer. The ion current generated may be considered as (quasi-) continuous. The described embodiments can be incorporated into a wide array of mass spectrometer apparatus. Examples of the source of ions may include any one of: an ion source (such as electrospray ionisation (ESI) or matrix-assisted laser desorption/ionization (MALDI)); an atmosphere-to-vacuum interface; an ion guide; a mass analyser or ion mobility analyser; or an ion trap. The described examples may be used to control ion filling of an ion trap of any type, with or without gas, including but not limited to: a radio-frequency (RF) trap (quadrupole, linear, etc.); a Penning trap; an electrostatic trap (e.g. Orbitrap™ analyser); or a time-of-flight trap. The described examples could be also installed between ion traps.

Figure 10:
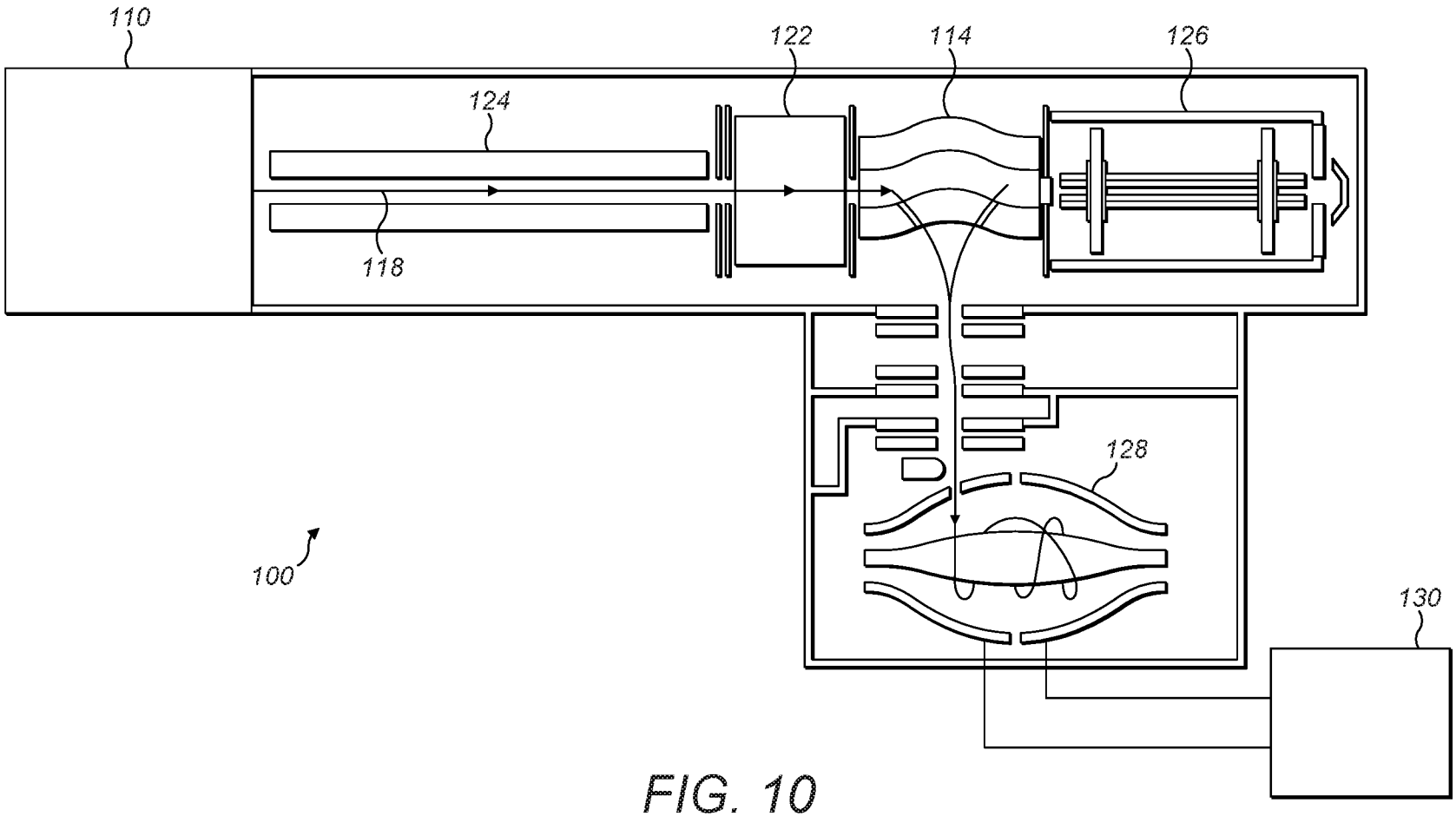
FIG. 10 is a schematic representation of an orbital-trapping mass spectrometer arranged to implement a method for controlling the filling of an ion trap with a predetermined quantity of ions.

FIG. 10 illustrates a preferred example, in which the invention is employed within a quadrupole-orbital trapping mass spectrometer 100 (such as an Orbitrap™ analyser). The quadrupole-orbital trapping mass spectrometer 100 depicted incorporates an ion source 110, a quadrupole ion mass filter 124, a curved ion trap (or C-trap) 114, a higher-energy collisional dissociation (HCD) cell 126, an orbital trapping mass analyser 128 and a digital-to-analogue converter 130. Arranged between the quadrupole ion filter 124 and the curved ion trap (or C-trap) 114 (and therefore between the ion source 110 and the curved ion trap 114), is apparatus 122. Apparatus 122 represents the portions of either FIG. 1, FIG. 2, FIG. 6, or FIG. 7 in marked area 22 of these Figures. Apparatus 122 includes the ion detector 12, in some examples together with ion optics 20 and an ion dump 60. In other words, apparatus 122 represents the configuration of the ion detector required to implement the invention described herein. In addition, to the components shown in FIG. 10 of mass spectrometer 100, various ion optics (not shown in FIG. 10) may be implemented to guide and focus the ion beam though the mass spectrometer.

In use, over a transmission time period ions from the ion source 114 are transmitted along an ion path 118 through the quadrupole ion filter 124, via the apparatus 122, to the C-trap 114 where they are accumulated together. This provides an ion current which is inherently varying in time. Subsequent to the elapse of the transmission time period, in order to obtain a fragment ion mass spectrum (MS2 spectrum), the accumulated ions are passed from the C-trap 114 to the HCD cell 126 for fragmentation. The ions are then returned to the C-trap 114 before injection into the mass analyser 128, in order to perform an analytical scan. In some embodiments, the ions may be transmitted (without trapping) through the C-trap 114 to the HCD cell 126 for fragmentation or cooling and then returned to the C-trap where they are finally trapped. In order to obtain a precursor ion mass spectrum (MS1 spectrum), the accumulated ions are injected from the C-trap 114 into the mass analyser 128 without fragmentation in the HCD cell 126, in order to perform an analytical scan.

The apparatus 122 includes an ion detector which intermittently detects (or samples) the ion current (as described above with reference to FIG. 1, FIG. 2, FIG. 6 or FIG. 7). Specifically, the ions are detected at the ion detector during a plurality of sampling time intervals. The time difference between a sampling time interval and the start of the subsequent sampling time interval (related to the sampling frequency) is set to be less than the timescale of variation of the ion current. In this way, the detector can monitor the ion current, in order to accurately predict the quantity of ions received at the C-trap 114. Accordingly, the C-trap 114 can be filled to the maximum ion population allowed without exceeding the space-charge limit.

It is noted that in this example, the C-trap 114 is filled with bath gas up to $1e^{-3}$ mbar. Thus, collisional fragmentation of ions can be expected to occur. In order to avoid this, an additional short radio frequency-only multipole (5-15 mm long) (not shown in FIG. 10) can be inserted between the detector exit and C-trap entrance. Furthermore, in this case an ion lens forming part of the ion optics shown in FIG. 2, FIG. 6 or FIG. 7 could also be used as shields to reduce radio frequency penetration or noise at the sensitive detector circuitry.

Figure 11:
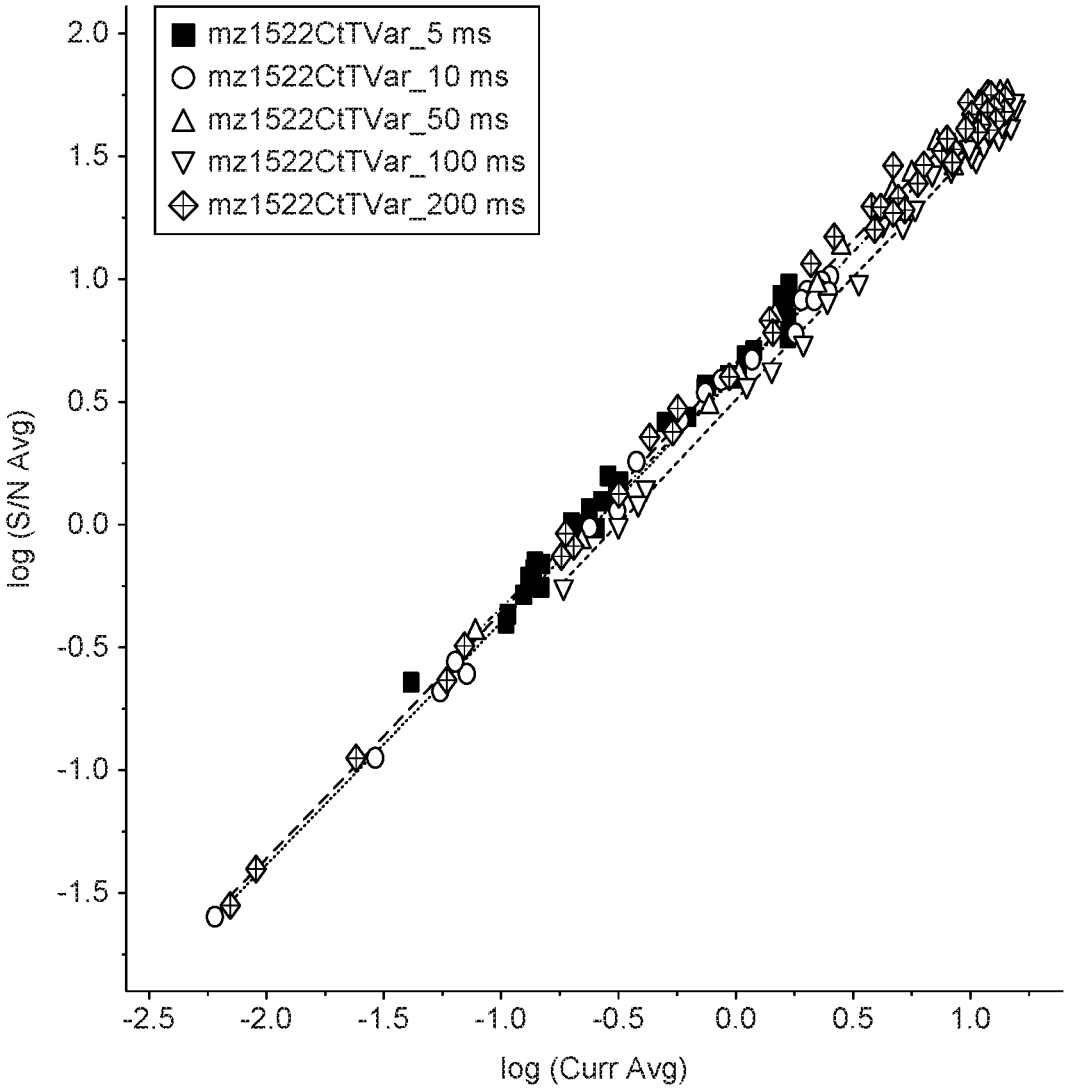
FIG. 11 is a plot of the signal-to-noise ratio of ions measured in a mass spectrometer of the type shown in FIG. 10.

FIG. 11 shows the signal-to-noise ratio of ions measured by an orbital trapping mass analyser in a mass spectrometer of the type shown in FIG. 10. The signal-to-noise ratio is plotted versus the ion current measured by an electrometer for different mass-to-charge ratio (m/z). The data was measured incorporating the noise reduction circuitry of FIG. 9. As can be seen in FIG. 11, differences in the stability of the measured current resulting from the different mass-to-charge ratios of the ions can be compensated for by the use of the described examples, as confirmed by the resulting linear relation between the current measured by the electrometer and signal-to-noise ratio acquired by the Orbitrap™ analyser.

To avoid m/z-dependant bias in mass spectra, it is preferable to perform calibration of the above-described method using compounds of different m/z and then correct subsequently acquired mass spectra.

Many combinations, modifications, or alterations to the features of the above embodiments will be readily apparent to the skilled person and are intended to form part of the invention. Any of the features described specifically relating to one embodiment or example may be used in any other embodiment by making the appropriate changes.

Although not necessarily shown in the specific examples above, it will be understood by the skilled person that a variety of additional ion optics may be employed in order to gate, filter or otherwise control the ion beam in the apparatus and in particular ions traversing the ion path. For example, beam focussing lenses may be employed.

In addition, a gas-filled ion guide may be employed prior to the ion trap. Ions from an ion source (such as an electrospray ionisation source (ESI) or matrix-assisted laser desorption/ionization ion source (MALDI)) may be transmitted to the ion trap via the gas-filled ion guide. In this example, passage through the gas-filled ion guide can result in broadening of any changes in the ion current. For example, diffusional broadening can result in 'smoothing' or broadening of any step changes in the ion current. In this example, the characteristic time of variation of the ion current is affected by said diffusional broadening. Thus, the ion detector should be arranged subsequent to the gas-filled ion guide (but before the ion trap), and the time difference between the start of a sampling time interval and the start of an immediately subsequent sampling time interval should take into account the diffusional broadening.

In the above examples, a number of specific types of ion detector are discussed. Nevertheless, it will be understood by the skilled person that various types of ion detector can be used within the configurations described. For instance, the ion detector may be (but is not limited to) a Faraday cup, a single-ion detector, secondary electron multiplier, an electrometer, an ion-to-photon detector, a microchannel plate detector, or another type of electron multiplier.

Similarly, it will be understood that the invention is not limited to use of any particular type of ion source described above. The invention requires a source of ions which may be any apparatus and device which can provide or supply ions to the ion path. The ions may be generated at the source of ions, or merely stored and transmitted therefrom. Accordingly, the types of ion source for use with the invention may include any of an ion trap, an ion source, an electrospray ionisation source (ESI), matrix-assisted laser desorption/ionization ion source (MALDI), a mass analyser, or an ion mobility analyser.

Moreover, the type of ion trap used within the invention may be of any type, and is not limited to those discussed with reference to the examples above. For instance, the ion trap may be one of a radio frequency trap (for instance, a quadrupole ion trap cylindrical ion trap or a linear quadrupole ion trap), a Penning trap, an electrostatic trap, a time of flight trap, or a curved trap.

Finally, although the invention is discussed specifically with reference to an orbital trapping mass analyser in relation to FIG. 9, it will be understood that the invention could be used in conjunction with any type of mass analyser. For instance, the present invention may be used within a time-of-flight mass spectrometer, a quadrupole mass spectrometer, a sector field mass spectrometer, or a Fourier transform ion cyclotron resonance mass spectrometer.

The invention claimed is:

1. A method for controlling the filling of an ion trap with a predetermined quantity of ions, the method comprising:

generating an ion current by transmitting ions along an ion path, the ion path extending from a source of ions to an ion trap such that ions are accumulated in the ion trap over a transmission time period, wherein the magnitude of the ion current varies in time;

detecting at an ion detector at least some ions from the source of ions during a plurality of distinct sampling time intervals interspersed within the transmission time period;

setting the duration of the transmission time period based on the detection of ions at the ion detector; and wherein the time difference between the start of a sampling time interval and the start of an immediately subsequent sampling time interval is less than a timescale for variation of the magnitude of the ion current, the timescale for variation being a period of time that the ion current undergoes a threshold change in its magnitude.

2. The method of claim 1, wherein setting the duration of the transmission time period based on the detection of ions at the ion detector comprises setting the transmission time period based on the total quantity of ions detected at the ion detector during the plurality of sampling time intervals.

3. The method of claim 1, wherein the time difference between the start of a sampling time interval and the start of an immediately subsequent sampling time interval is less than a predefined percentage of the timescale for variation of the magnitude of the ion current.

4. The method of claim 3, wherein the predefined percentage is one of: 10%, 20%, 50%, or 90%.

5. The method of claim 1, wherein the timescale for variation of the magnitude of the ion current is an average period of the current variation.

6. The method of claim 1, wherein the timescale for variation of the magnitude of the ion current is determined based on a transform of the ion current to the frequency domain.

7. The method of claim 1, wherein the timescale for variation of the magnitude of the ion current is the average time period in which the ion current changes by at least a predetermined percentage of its maximum magnitude.

8. The method of claim 1, wherein the timescale for variation of the magnitude of the ion current is the average time difference between instances of the ion current being equal to the moving average magnitude of the ion current.

9. The method of claim 1, wherein the magnitude of the ion current varies approximately stepwise, and the timescale for variation of the magnitude of the ion current is the average width of peaks in the derivative of the ion current against time.

10. The method of claim 1, wherein the method further comprises, prior to detecting at the ion detector at least some ions from the source of ions during a plurality of distinct sampling time intervals, steps of:

receiving a measurement of the ion current over a premeasurement time period; and determining the timescale for variation of the magnitude of the ion current over the premeasurement time period.

11. The method of claim 1, further comprising:
providing at least one ion detector along the ion path, between the source of ions and the ion trap.

12. The method of claim 1, wherein detecting at an ion detector at least some ions from the source of ions during a plurality of distinct sampling time intervals comprises, prior to detecting the at least some ions, directing the at least some ions from the ion path towards the ion detector during each distinct sampling time interval.

13. The method of claim 12, further comprising:
providing the one ion detector external to the ion path;
providing at least one switching device along the ion path, arranged between the source of ions and the ion trap;
wherein the switching device is configured to direct ions from the source of ions towards the ion detector external to the ion path during each distinct sampling time interval.

14. The method of claim 1, further comprising:
terminating the transmission of ions along the ion path once the transmission period has elapsed.

15. The method of claim 1, wherein setting the duration of the transmission time period comprises terminating the transmission of ions along the ion path when a total quantity of ions detected at the ion detector during the plurality of sampling time intervals exceeds a pre-defined value.

16. The method of claim 1, further comprising:
providing at least one gas-filled ion guide along the ion path, between the source of ions and the ion trap.

17. The method of claim 16, wherein the timescale for variation of the magnitude of the ion current is less than a temporal broadening of step changes in the magnitude of an ion current entering the gas-filled ion trap, resulting from ion collisions with gas in the gas-filled guide.

18. A controller for controlling the filling of an ion trap with a predetermined quantity of ions, the controller configured to:
receive a measurement based on a quantity of ions detected at an ion detector during a plurality of distinct sampling time intervals, the ions transmitted from a source of ions, wherein an ion path extends from the source of ions to an ion trap such that ions are accumulated at the ion trap over a transmission time period, wherein ions transmitted along the ion path generate an ion current and the magnitude of the ion current varies in time, and wherein the plurality of distinct sampling time intervals interspersed within the transmission time period; and
set the duration of the transmission time period based on the ions detected at the ion detector; and
wherein the time difference between the start of a sampling time interval and the start of an immediately subsequent sampling time interval is less than the timescale for variation of the magnitude of the ion current, the timescale for variation being a period of time that the ion current undergoes a threshold change in its magnitude.

19. The controller of claim 18, wherein the controller is configured to set the duration of the transmission time period based on the total quantity of ions detected at the ion detector during the plurality of sampling time intervals.

20. The controller of claim 18, wherein the controller is further configured to:
set the duration of the sampling time interval.

21. The controller of claim 18, further configured to:
set the time difference between the start of a sampling time interval and the start of an immediately subsequent sampling time interval.

22. The controller of claim 21, further configured to:
set the time difference between the start of a sampling time interval and the start of an immediately subsequent sampling time interval to be less than a predefined percentage of the timescale for variation of the magnitude of the ion current.

23. The controller of claim 22, wherein the predefined percentage is one of: 10%, 20%, 50%, or 90%.

24. The controller of claim 18, wherein the timescale for variation of the magnitude of the ion current is the average period of the current variation.

25. The controller of claim 18, wherein the timescale for variation of the magnitude of the ion current is determined based on a transform of the ion current to the frequency domain.

26. The controller of claim 18, wherein the timescale for variation of the magnitude of the ion current is the average time period in which the ion current changes by at least a predetermined percentage of its maximum magnitude.

27. The controller of claim 18, wherein the timescale for variation of the magnitude of the ion current is the average time difference between instances of the ion current being equal to the moving average magnitude of the ion current.

28. The controller of claim 18, wherein the magnitude of the ion current varies approximately stepwise, and the timescale for variation of the magnitude of the ion current is the average width of peaks in the derivative of the ion current against time.

29. The controller of claim 18, wherein prior to receiving the measurement based on a quantity of ions detected at an ion detector during the plurality of distinct sampling time intervals, the controller is further configured to:
receive a measurement of the ion current during a pre-measurement time period; and
determine the timescale for variation of the magnitude of the ion current during the pre-measurement time period.

30. The controller of claim 18, wherein the ion detector is arranged external to the ion path, the controller further configured to:
control a switching device arranged along the ion path between the source of ions and the ion trap, the switching device configured to direct ions from the source of ions to the ion detector;
wherein the controller is configured to control the switching device to direct ions from the source of ions towards the ion detector external to the ion path during each distinct sampling time interval.

31. The controller of claim 18, further configured to:
terminate the transmission of ions along the ion path once the transmission period has elapsed.

32. The controller of claim 18, wherein the controller configured to set the duration of the transmission time period based on the total quantity of ions detected at the ion detector during the sampling time intervals comprises the controller configured to terminate the transmission of ions along an ion path when the measurement of the total quantity of ions detected at the ion detector exceeds a pre-defined value.

33. A mass spectrometer comprising:
a source of ions;
an ion trap, arranged to receive ions transmitted along an ion path extending from the source of ions to the ion trap;
an ion detector arranged to be capable of detecting at least some ions from the source of ions;

a mass analyser, arranged to receive at least some ions from the ion trap; and a controller configured to:

receive a measurement based on a quantity of ions detected at the ion detector during a plurality of distinct sampling time intervals, the ions transmitted from the source of ions, wherein an ion path extends from the source of ions to the ion trap such that ions are accumulated at the ion trap over a transmission time period, wherein ions transmitted along the ion path generate an ion current and the magnitude of the ion current varies in time, and wherein the plurality of distinct sampling time intervals interspersed within the transmission time period, set the duration of the transmission time period based on the ions detected at the ion detector, wherein the time difference between the start of a sampling time interval and the start of an immediately subsequent sampling time interval is less than the timescale for variation of the magnitude of the ion current, the timescale for variation being a period of time that the ion current undergoes a threshold change in its magnitude.

34. The mass spectrometer of claim 33, wherein the ion detector is external to the ion path, the mass spectrometer further comprising:

an ion gate arranged along the ion path between the source of ions and the ion trap, the ion gate capable of directing ions from the source of ions towards the ion detector external to the ion path.

* * * * *